US010663911B2

(12) United States Patent
Uratani et al.

(10) Patent No.: US 10,663,911 B2
(45) Date of Patent: May 26, 2020

(54) CARTRIDGE, IMAGE FORMING APPARATUS AND ASSEMBLING METHOD OF DRIVE TRANSMISSION UNIT

(71) Applicant: CANON KABUSHIKI KAISHA, Tokyo (JP)

(72) Inventors: Shunsuke Uratani, Mishima (JP); Yu Fukasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/530,162

(22) Filed: Aug. 2, 2019

(65) Prior Publication Data

US 2019/0354061 A1 Nov. 21, 2019

Related U.S. Application Data

(60) Division of application No. 15/635,458, filed on Jun. 28, 2017, now Pat. No. 10,394,182, which is a (Continued)

(30) Foreign Application Priority Data

Mar. 10, 2015 (JP) ..... 2015-046613
Feb. 8, 2016 (JP) ..... 2016-021447

(51) Int. Cl.
*G03G 21/16* (2006.01)
*G03G 15/00* (2006.01)
*G03G 21/18* (2006.01)

(52) U.S. Cl.
CPC ..... *G03G 21/1647* (2013.01); *G03G 15/757* (2013.01); *G03G 21/1864* (2013.01); *G03G 21/1853* (2013.01); *G03G 2221/1657* (2013.01)

(58) Field of Classification Search
CPC ..... G03G 15/757; G03G 21/1857; G03G 21/1864; F16D 3/40
See application file for complete search history.

(56) References Cited

U.S. PATENT DOCUMENTS 7,110,703 B2 9/2006 Uratani et al.
7,283,765 B2 1/2007 Uratani et al.
(Continued)

FOREIGN PATENT DOCUMENTS

EP 2 790 065 A1 10/2014
JP 2010-002690 A 1/2010
(Continued)

OTHER PUBLICATIONS

Dec. 29, 2016 Office Action in Taiwanese Patent Application No. 105107420.
(Continued)

*Primary Examiner* — Erika J Villaluna
(74) *Attorney, Agent, or Firm* — Venable LLP

(57) ABSTRACT

A cartridge includes a rotatable member, a rotatable rotational force receiving member, a preventing member including an accommodating portion, a rotatable coupling member including a free end portion which includes a rotational force receiving portion and including a connecting portion connected with the preventing portion to be partly accommodated in the accommodating portion so that a rotational axis of the coupling member permits tilting thereof relative to a rotational axis of the rotational force receiving member, a shaft portion. The preventing member includes a supporting portion for supporting ends of the shaft portion so as to prevent the shaft portion from moving in a rotational direction of the rotatable member to transmit the rotational force received from the shaft portion via the supporting portion to the rotational force receiving member.

27 Claims, 16 Drawing Sheets

Related U.S. Application Data continuation of application No. PCT/JP2016/058418, filed on Mar. 10, 2016.

(56) References Cited

U.S. PATENT DOCUMENTS

| | | | |
|---|---|---|---|
| 8,208,830 | B2 | 6/2012 | Uratani et al. |
| 8,571,445 | B2 | 10/2013 | Komatsu et al. |
| 8,755,713 | B2 | 6/2014 | Kawai et al. |
| 8,879,954 | B2 | 11/2014 | Nonaka et al. |
| 8,909,096 | B2 | 12/2014 | Fukui et al. |
| 8,942,592 | B2 | 1/2015 | Uratani et al. |
| 9,188,940 | B2 | 11/2015 | Fukui et al. |
| 2008/0152388 | A1 | 6/2008 | Ueno et al. |
| 2009/0317131 | A1 | 12/2009 | Morioka et al. |
| 2010/0054823 | A1 | 3/2010 | Takasaka et al. |
| 2011/0159970 | A1 | 6/2011 | Okabe |
| 2014/0112685 | A1 | 4/2014 | Komatsu et al. |
| 2014/0270845 | A1 | 9/2014 | Kawakami et al. |
| 2015/0110522 | A1 | 4/2015 | Ikeda et al. |
| 2015/0220020 | A1 | 8/2015 | Hayashi et al. |
| 2016/0370756 | A1 | 12/2016 | Komatsu et al. |

FOREIGN PATENT DOCUMENTS

| | | | |
|---|---|---|---|
| JP | 2010-079283 | A | 4/2010 |
| JP | 2011-095604 | A | 5/2011 |
| JP | 2011-133682 | A | 7/2011 |
| JP | 2013-033301 | A | 2/2013 |
| JP | 2014112169 | A | 6/2014 |
| JP | 2014167656 | A | 9/2014 |
| JP | 2015-121776 | A | 7/2015 |
| TW | 200848959 | A | 12/2008 |
| TW | 201028806 | A | 8/2010 |
| TW | 201337477 | A | 9/2013 |
| TW | 201346465 | A | 11/2013 |
| TW | 201346466 | A | 11/2013 |
| TW | I596453 | B | 8/2017 |
| WO | 2015/005446 | A | 1/2015 |

OTHER PUBLICATIONS

Dec. 19, 2017 Office Action in Taiwanese Patent Application No. 106118425 (with English translation).

Notice of Allowance in Korean Patent Application No. 10-2017-7024259, dated Jul. 8, 2019.

Office Action in Korean Patent Application No. 10-2017-7024259, dated Jul. 25, 2019.

Office Action in Chinese Patent Application No. 201680013782.X, dated Oct. 15, 2018 (with English translation).

International Search Report and Written Opinion for International Patent Application No. PCT/JP2016/058418.

Feb. 4, 2020 Office Action in Japanese Patent Application Pub. No. 2016-021447.

(a)

(b)

(a)

(b)

(a)

(b)

CARTRIDGE, IMAGE FORMING APPARATUS AND ASSEMBLING METHOD OF DRIVE TRANSMISSION UNIT

TECHNICAL FIELD

The present invention relates to a cartridge for use with an image forming apparatus, the image forming apparatus including the cartridge, and an assembling method of a drive transmission unit for transmitting a rotational force to a rotatable member.

The cartridge includes at least one of a photosensitive drum and process means and is detachably mountable to a main assembly of the image forming apparatus (hereinafter referred to as an apparatus main assembly). As a representative example of the cartridge, a process cartridge can be cited. The process cartridge is prepared by integrally assembling the photosensitive drum and the process means, such as a developing means, actable on the photosensitive drum into a cartridge (unit), which is detachably mountable to the apparatus main assembly.

Further, the image forming apparatus forms an image on a recording material (medium) using an electrophotographic image forming process or the like. Examples of the image forming apparatus include a copying machine, a printer (LED printer, laser beam printer, or the like), a facsimile machine, a word processor, and so on.

BACKGROUND ART

Conventionally, in an electrophotographic image forming apparatus, depending on an operator (user), a cartridge type in which the cartridge is mounted in and demounted from the apparatus main assembly is employed. According to this cartridge type, maintenance of the electrophotographic image forming apparatus can be performed by the user himself (herself) without relying on a service person, and therefore operativity can be remarkably improved. For this reason, the cartridge type has been widely used in the electrophotographic image forming apparatus.

As a constitution of the cartridge, a constitution in which the cartridge is mounted in and demounted from the apparatus main assembly in a predetermined direction substantially perpendicular to an axis of a rotatable member such as the photosensitive drum has been known. As a constitution of the apparatus main assembly, a constitution in which a main assembly-side engaging portion for transmitting the rotational force to the photosensitive drum is provided and a coupling member provided in the cartridge is engaged with the main assembly-side engaging portion, and thus the rotational force is transmitted from the main assembly-side engaging portion to the cartridge via the coupling member has been known.

In such a cartridge type, a constitution in which the coupling member and a rotational force receiving member (member to which the rotational force is to be transmitted) are provided in a photosensitive drum unit and a part of the coupling member is accommodated in the rotational force receiving member, and the coupling member is tiltable relative to an axis of the photosensitive drum unit is employed. In this constitution, with a mounting and demounting operation of the cartridge relative to the apparatus main assembly, an engaging operation and a demounting operation of the coupling member can be performed. In addition, such a constitution that the coupling member and the rotational force receiving member are connected with each other by a shaft portion and thus the rotational force transmitted from the main assembly-side engaging portion to the coupling member is transmitted from the member to the rotational force receiving member via the shaft portion has been known (Japanese Laid-Open Patent Application (JP-A) 2014-112169).

However, in a conventional constitution disclosed in FIG. 20 of JP-A 2014-112169, in order to transmit the rotational force from the coupling member to the rotational force receiving member, the rotational force receiving member is provided with a groove portion for supporting the shaft portion. Then, the shaft portion contacts the groove portion of the rotational force receiving member, so that the rotational force is transmitted from the coupling member to the rotational force receiving member. In such a case, the rotational force is exerted on the groove portion of the rotational force receiving member, so that depending on a magnitude of the rotational force, not only the groove portion of the rotational force receiving member but also the rotational force receiving member itself largely deform in some instances. As a result, the rotational force receiving member rotates in a distorted state, so that there is a possibility that rotation of the rotational force receiving member and the photosensitive drum unit with high accuracy is impaired.

Further, in the rotational force receiving member, rotates where the groove portion is provided and the groove portion is not provided co-exist, so that a shape of the rotational force receiving member becomes complicated. In such a case, when the rotational force receiving member is molded, flowability of a resin material becomes non-uniform, so that it becomes difficult to mold the rotational force receiving member with high accuracy in some instances.

SUMMARY OF THE INVENTION

A principal object of the present invention is to provide a degree of deformation of a rotational force receiving member when a rotational force is transmitted to the rotational force receiving member in a cartridge for use with an apparatus main assembly.

Another object of the present invention is to mold the rotational force receiving member with high accuracy (precision) by making flowability of a resin material when the rotational force receiving member is molded.

According to an aspect of the present invention, there is provided a cartridge detachably mountable to a main assembly of an image forming apparatus, comprising: a rotatable member; a rotatable rotational force receiving member for transmitting a rotational force to be transmitted to the rotatable member; a preventing member connected with the rotational force receiving member and including an accommodating portion therein; a rotatable coupling member including a free end portion which includes a rotational force receiving portion for receiving the rotational force and including a connecting portion connected with the preventing portion to be partly accommodated in the accommodating portion so that a rotational axis of the coupling member permits tilting thereof relative to a rotational axis of the rotational force receiving member; and a shaft portion capable of receiving the rotational force from the coupling member, wherein the preventing member includes a supporting portion for supporting ends of the shaft portion so as to prevent the shaft portion from moving in a rotational direction of the rotatable member to transmit the rotational force received from the shaft portion via the supporting portion to the rotational force receiving member.

Further features of the present invention will become apparent from the following description of exemplary embodiments with reference to the attached drawings.

DESCRIPTION OF EMBODIMENTS

Figure 1:
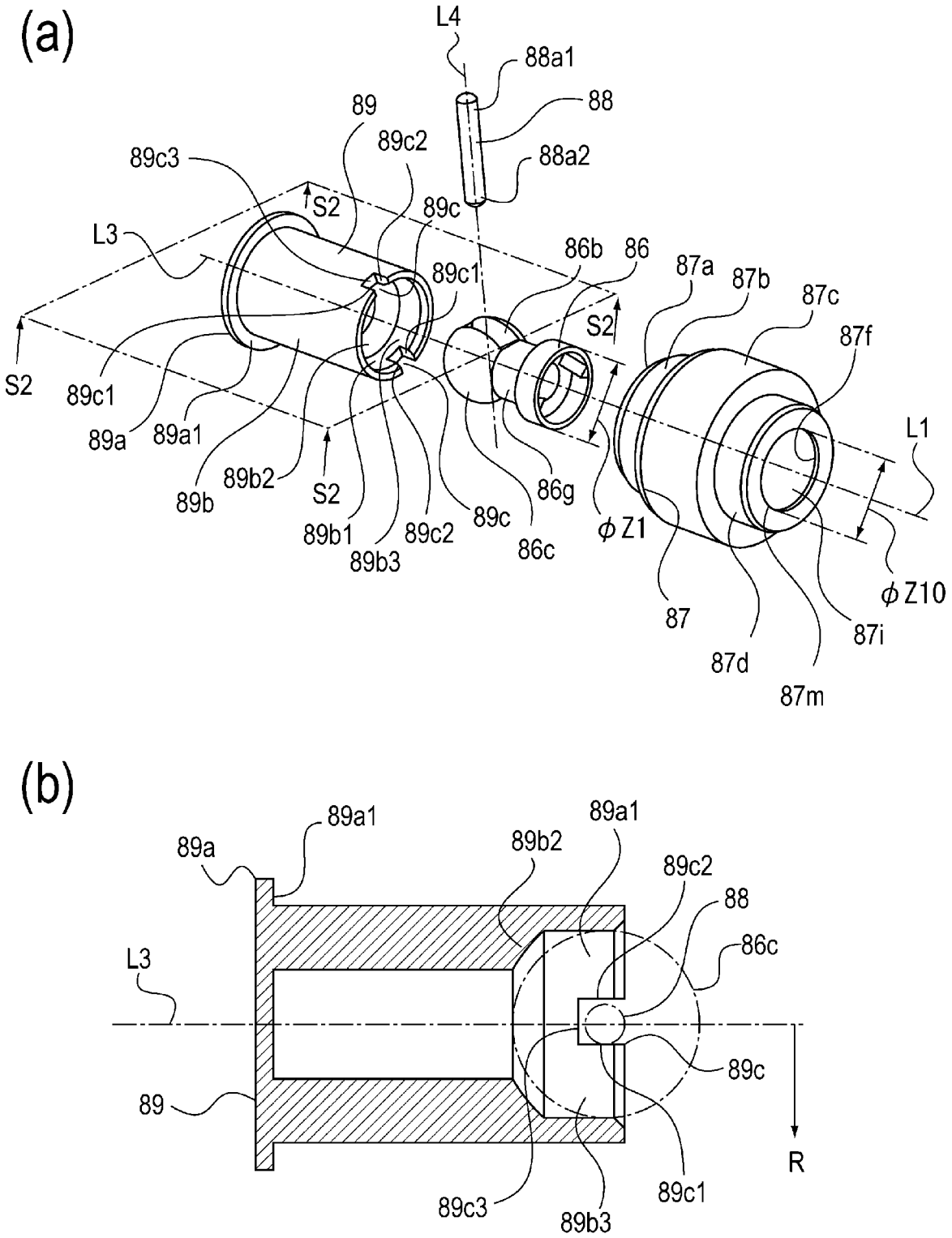
In FIG. 1, (a) and (b) are illustrations each showing a state of a driving-side flange unit in Embodiment 1 to which the present invention is applicable.

A cartridge and an electrophotographic image forming apparatus according to the present invention will be described with reference to the drawings. In the following, as the electrophotographic image forming apparatus, a laser beam printer main assembly and a process cartridge detachably mountable to the laser beam printer main assembly will be described, for example.

In the following description, a longitudinal direction of the process cartridge is a direction substantially parallel to a rotational axis L1 of a photosensitive drum as a rotatable member for carrying a developer and a rotational axis L5 of a developing roller. Further, the longitudinal direction of the process cartridge is a direction substantially perpendicular to a direction in which the process cartridge is mounted in and demounted from an electrophotographic image forming apparatus main assembly and is a direction crossing a feeding direction of a recording material. Further, with respect to the longitudinal direction of the process cartridge, a side where the photosensitive drum receives the rotational force from the apparatus main assembly is a driving side, and a side opposite from the driving side is a non-driving side. Further, a widthwise (short) direction is a direction substantially perpendicular to the rotational axis L1 of the photosensitive drum and the rotational axis L5 of the developing roller.

Reference numerals or symbols in the description are used for making reference to the drawings, but do not limit constitutions. Further, functions, dimensions, materials and relative arrangements of constituent elements or portions described in the following embodiments are not intended that the scope of the present invention is limited only thereto.

Embodiment 1

(1) General Structure of Image Forming Apparatus

Figure 2:
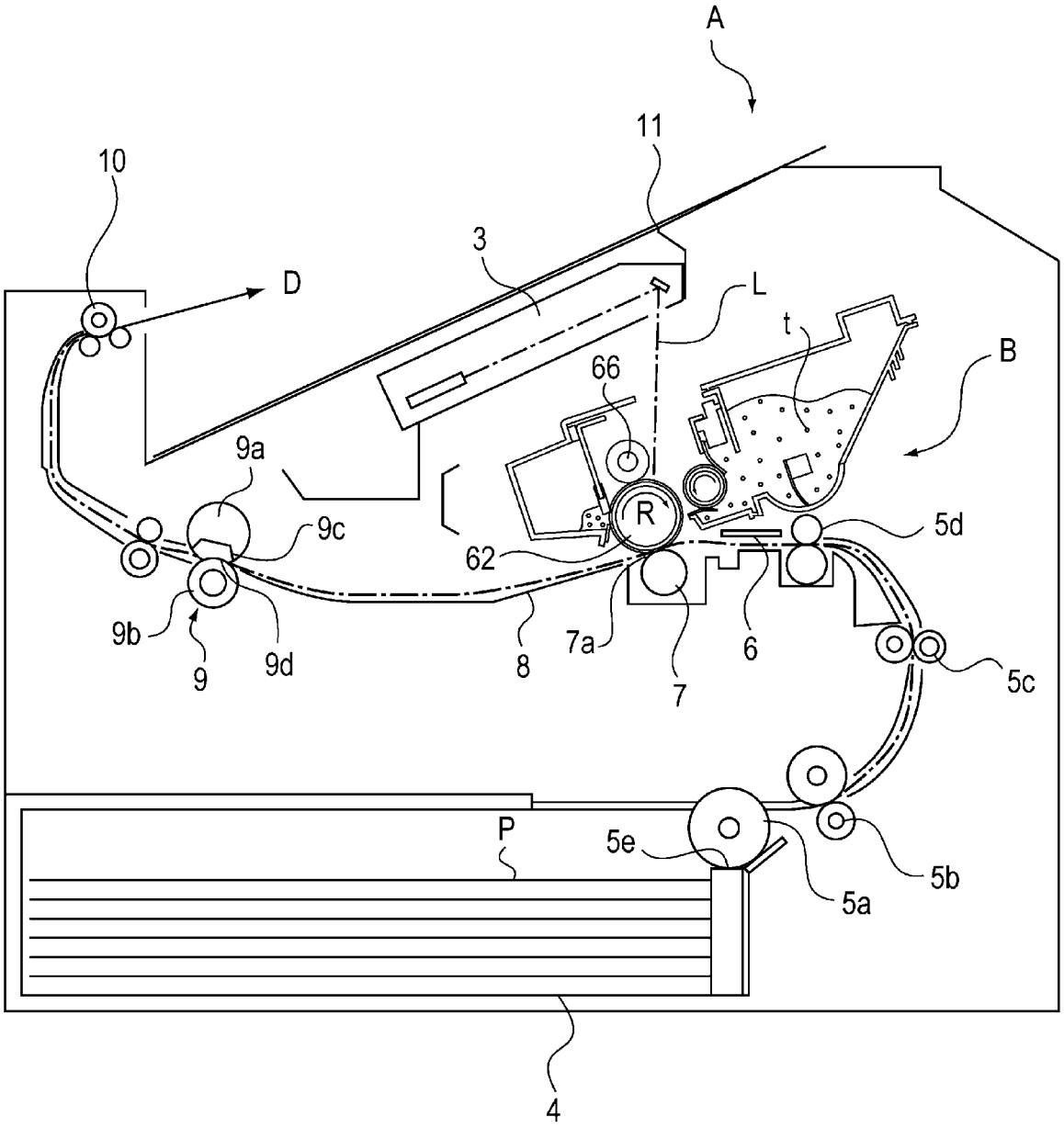
FIG. 2 is a schematic side illustration of an electrophotographic image forming apparatus in the Embodiment 1.

A general structure of an electrophotographic image forming apparatus to which an embodiment of the present invention is applied will be described using FIG. 2. FIG. 2 is a side illustration of the image forming apparatus in this embodiment.

The image forming apparatus shown in FIG. 2 forms an image on a recording material P with a developer by an electrophotographic image forming process depending on image information sent from an external device such as a personal computer. As an example of the recording material P, it is possible to cite recording paper, label paper, an OHP sheet, a cloth and the like. The image forming apparatus is provided with a process cartridge so as to be mountable in and demountable from an electrophotographic image forming apparatus main assembly by a user (operator). In the following description, the process cartridge is referred to as a "cartridge B", and the electrophotographic image forming apparatus main assembly is referred to as an "apparatus main assembly A". The apparatus main assembly A is a portion of the image forming apparatus from which the cartridge B is excluded.

On the basis of a print start signal, a photosensitive drum 62 as a rotatable member is rotationally driven in an arrow R direction at a predetermined peripheral speed (process speed). The photosensitive drum 62 is electrically charged uniformly at a surface thereof by a charging roller 66 under application of a voltage from the apparatus main assembly A. Further, the charged photosensitive drum 62 is irradiated with laser light L, depending on image information, from an optical means 3, so that an electrostatic latent image depending on the image information is formed on the photosensitive drum 62. This electrostatic latent image is developed with a developer by a developing means described later.

In the apparatus main assembly A, along a feeding direction D of the recording material P, a pick-up roller 5*a*, a feeding roller pair 5*b*, a conveying roller pair 5*c*, a registration roller pair 5*d*, a transfer guide 6, a transfer roller 7, a feeding guide 8, a fixing device 9, a discharging roller pair 10, a discharge tray 11, and so on are successively provided. The fixing device 9 includes a heating roller 9*a* incorporating therein a heater 9*c* and includes a pressing roller 9*b*.

On the other hand, the recording material P accommodated in a feeding tray 4 is separated and fed one by one by the pick-up roller 5*a* and a separation pad 5*e* press-contacted to the pick-up roller 5*a* in synchronism with formation of the developer image. Then, the recording material P is fed by the feeding roller pair 5*b*, the conveying roller pair 5*c* and the registration roller pair 5*d*, and then supplied to between the photosensitive drum 62 and the transfer roller 7 via the transfer guide 6. The transfer roller is urged so as to contact the surface of the photosensitive drum 62.

Then, the recording material P passes through a transfer nip 7*a* formed by the photosensitive drum 62 and the transfer roller 7. At this time, by applying a voltage of an opposite polarity to the polarity of the developer image to the transfer roller 7, the developer image formed on the surface of the photosensitive drum 62 is transferred onto the recording material P.

The recording material P on which the developer image is transferred is separated from the photosensitive drum 62 and then is fed to the fixing device 9 along the feeding guide 8. To the recording material P, heat and pressure are applied when the recording material P passes through the nip 9*d* between the heating roller 9*a* and the pressing roller 9*b*, so that the developer image transferred on the recording material P is fixed on the recording material P. As a result, the image is formed on the recording material P. Thereafter, the recording material P is fed to the discharging roller pair 10, and then is discharged to the discharge tray 11.

(2) General Structure of Cartridge B

Figure 3:
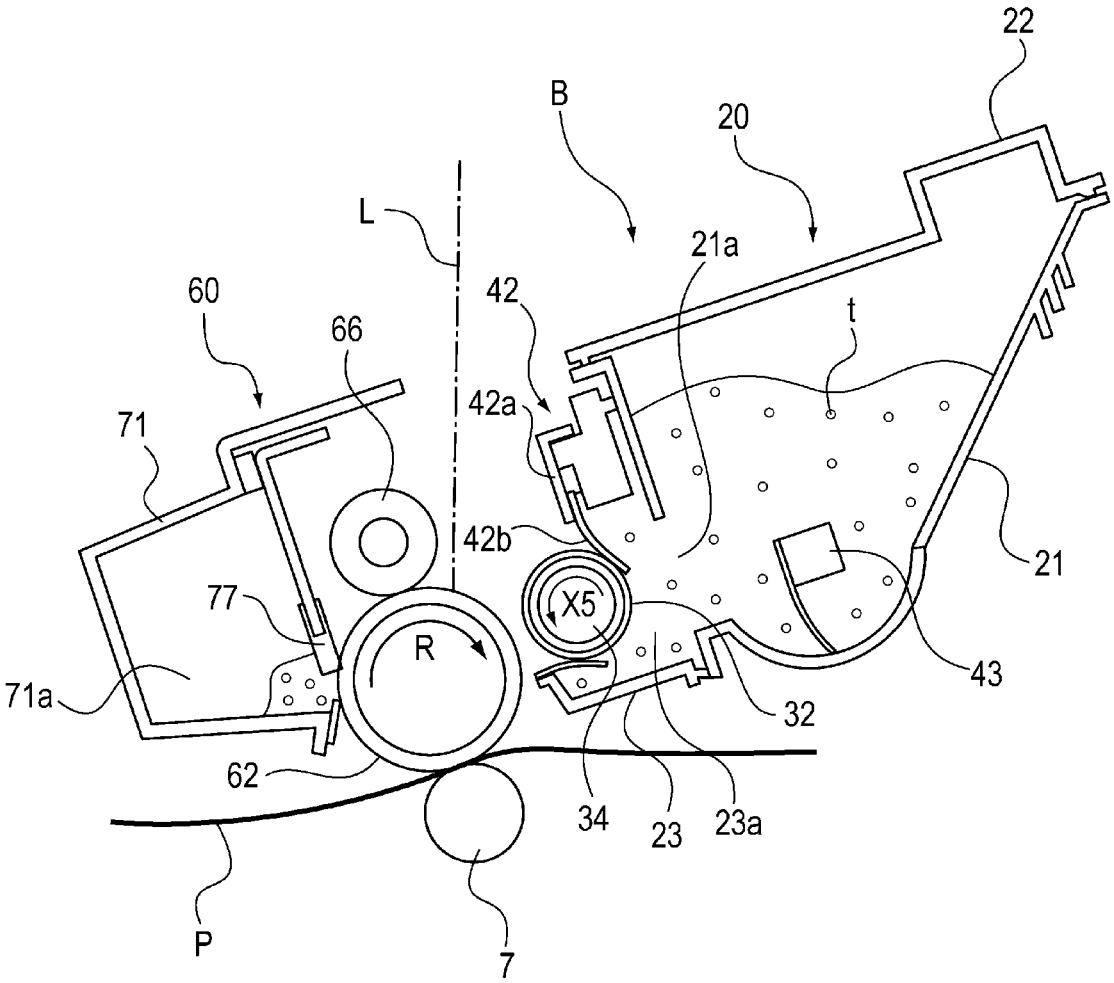
FIG. 3 is a schematic side illustration of a process cartridge in the Embodiment 1.
Figure 4:
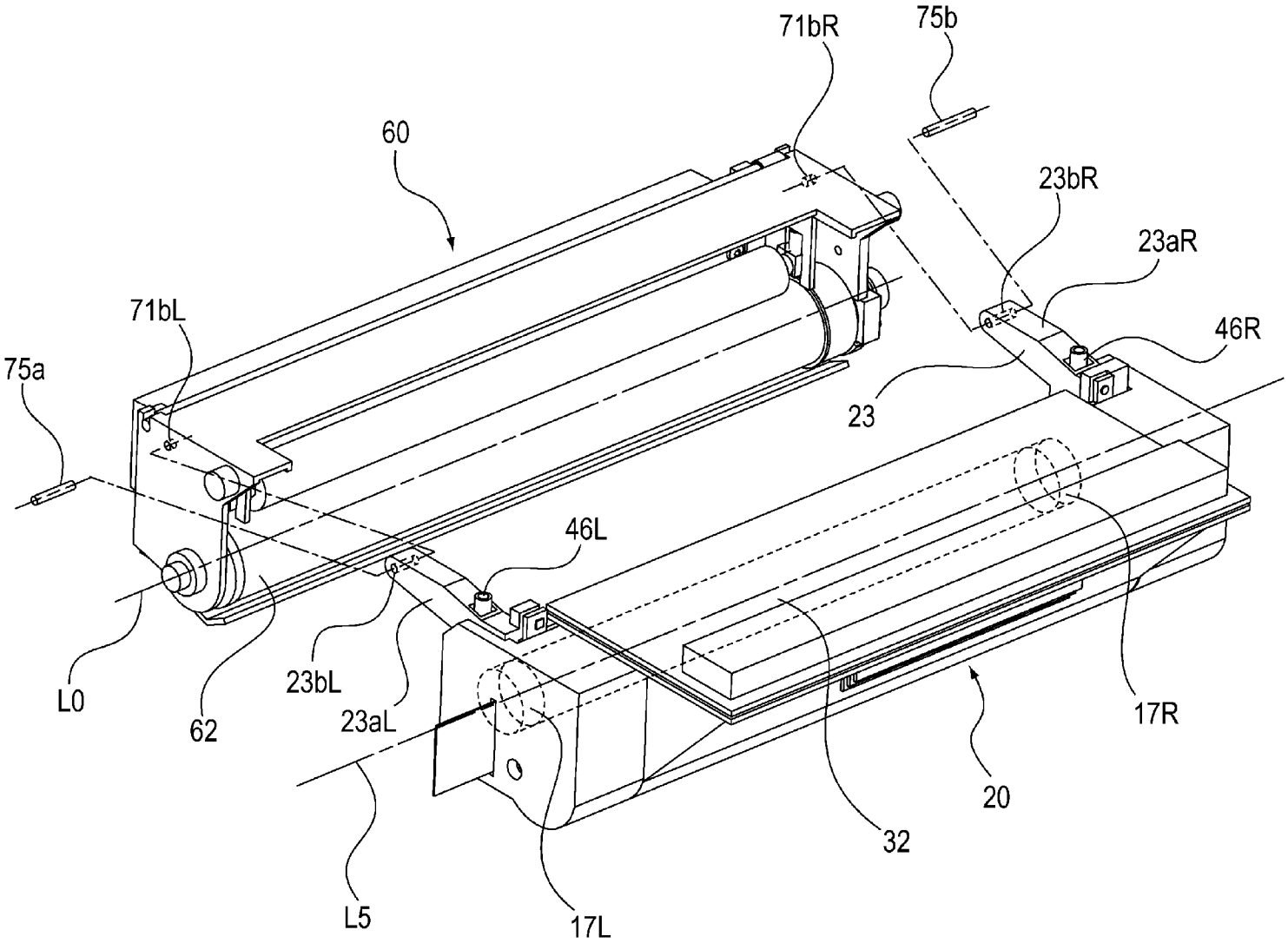
FIG. 4 is a perspective illustration showing an exploded state of the process cartridge in the Embodiment 1.

Using FIGS. 3 and 4, the cartridge B in this embodiment will be described. FIG. 3 is a side illustration of the cartridge B. FIG. 4 is a perspective illustration showing an exploded state of the cartridge B.

As shown in FIG. 3, the cartridge B is consisting of a developing unit 20 and a cleaning unit 60. The developing unit 20 includes a developing roller 32 as a developing means, a developing blade 42, a developer accommodating container 21, a cap 22, a developing container 23, a magnet roller 34, a developer feeding member 43, a developer t and the like. Further, the cleaning unit 60 includes a cleaning frame 71, the photosensitive drum 62, a cleaning blade 77, the charging roller 66 and the like.

The developer t accommodated in the developer accommodating container 21 is sent into a developing chamber 23*a* of the developing container 23 through an opening 21*a* of the developer accommodating container 21. The developing container 23 is provided with the developing roller 32 incorporating a magnet roller 34 therein. The developing roller 32 attracts the developer t in the developing chamber 23*a* to the surface of the developing roller 32 by a magnetic force of the magnet roller 34. The developing blade 42 is constituted by a supporting member 42*a* formed with a metal plate and an elastic member 42*b* formed with an elastic member such as an urethane rubber, and is provided so that the elastic member 42*b* elastically contacts the developing roller 32 with a certain contact pressure. Further, the developing roller 32 rotates in a rotational direction X5, so that an amount of the developer t deposited on the surface of the developing roller 32 is defined and triboelectric charges are imparted to the developer t. As a result, a developer layer is formed on the surface of the developing roller 32. By rotating the developing roller 32, to which a voltage is applied from the apparatus main assembly A, in the rotational direction X5, the developer t is supplied to a developing region of the photosensitive drum 62.

On an outer peripheral surface of the photosensitive drum 62, the charging roller 66 is provided in contact with the photosensitive drum 2 in a state in which the charging roller 66 is rotatably supported and urged by the cleaning frame 71. The charging roller 66 uniformly charges the surface of the photosensitive drum 62 by application of a voltage from the apparatus main assembly A. Then, by the laser light L from the optical means 3, the electrostatic latent image is formed on the surface of the photosensitive drum 62. Then, in the developing region, the developer t is transferred depending on the electrostatic latent image on the photosensitive drum 62 to visualize the electrostatic latent image, so that the developer image is formed on the photosensitive drum 1.

The cleaning blade 77 is provided elastically in contact with the outer peripheral surface of the photosensitive drum 62 and scrapes off the developer t remaining on the photosensitive drum 2 after the developer image is transferred onto the recording material P. The scraped developer t is applied in a removed developer accommodating portion 71*a* of the cleaning frame 71 to which the cleaning blade 77 is fixed.

As shown in FIG. 4, the cartridge B is constituted by combining the cleaning unit 60 with the developing unit 20, and these units are rotatably connected with each other by connecting members 75*a*, 75*b*. Specifically, arm portions 23*a*L, 23*a*R are formed at ends of the developing container 23 with respect to a longitudinal direction (rotational axis direction L5). At end portions of the arm portions 23*a*L, 23*a*R, rotation holes 23*b*L, 23*b*R parallel to the rotational axis direction L5 of the developing roller 32 are provided, respectively. At longitudinal end portions of the cleaning frame 71, engaging holes 71*b*L, 71*b*R for engaging with the connecting members 75*a*, 75*b* are formed. Then, the developing unit 20 is disposed at a predetermined position so that the rotation holes 23*b*L, 23*b*R coincide with the engaging holes 71*b*L, 71*b*R, respectively, and then the connecting members 75*a*, 75*b* are inserted into the rotation holes 23*b*L, 23*b*R and the engaging holes 71*b*L, 71*b*R. As a result, the cleaning unit 60 and the developing unit 20 are connected with each other so as to be rotatable about the connecting members 75*a*, 75*b*.

At this time, urging members 46L, 46R secured to base portions of the arm portions 23*a*L, 23*a*R abut against the cleaning frame 71, and urge the developing unit 20 toward the cleaning unit 60 with the connecting members 75 (75*a*, 75*b*) as a rotation center. As a result, the developing roller 32 is pressed in the direction of the photosensitive drum 62 with reliability.

The developing roller 32 is positioned with a predetermined gap (spacing) from the photosensitive drum 62 by spacing-holding members 17L, 17R secured to end portions of the developing roller 32.

Figure 5:
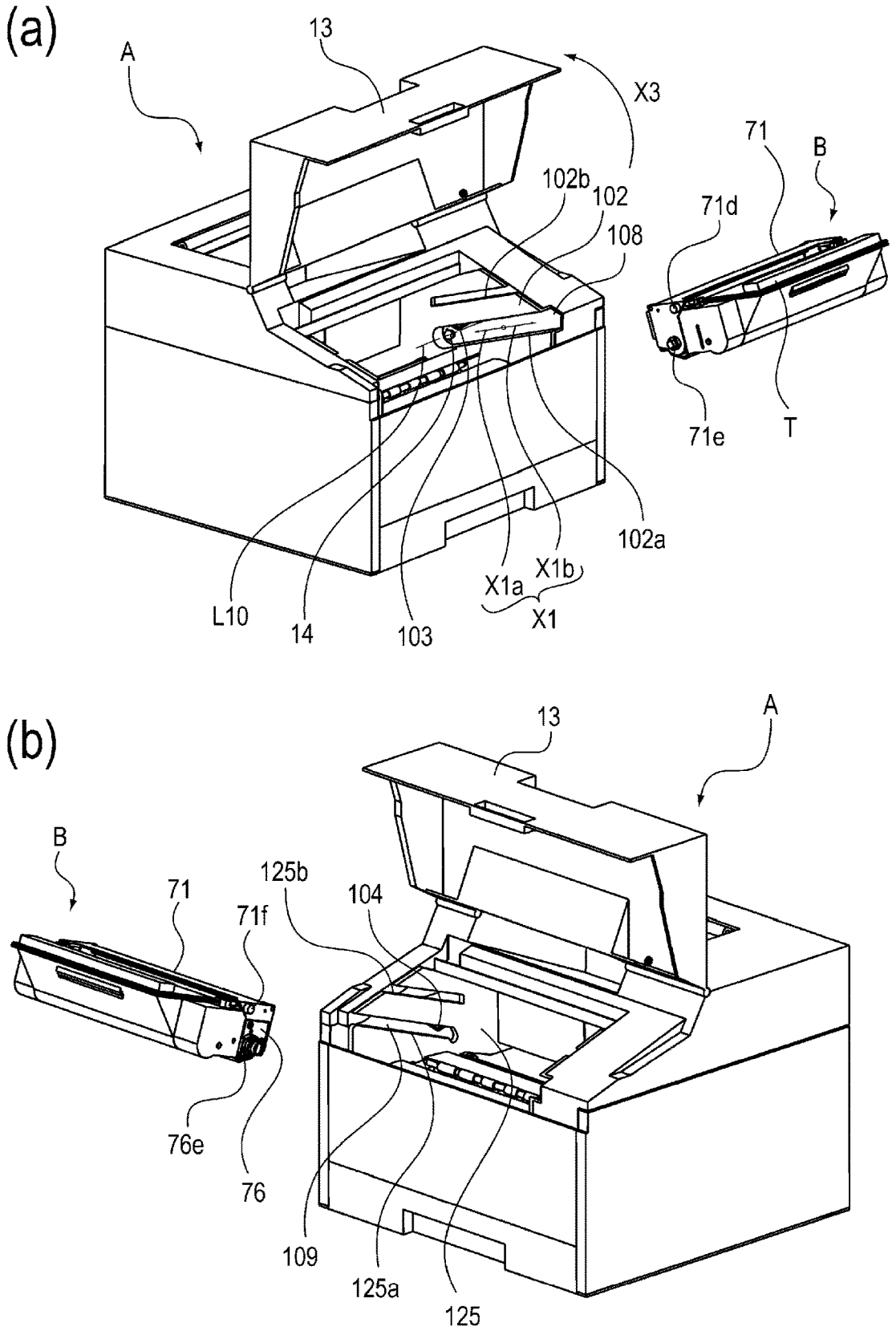
In FIG. 5, (a) and (b) are illustrations each showing a state in which the process cartridge is mounted in a main assembly of the electrophotographic image forming apparatus in the Embodiment 1.
Figure 6:
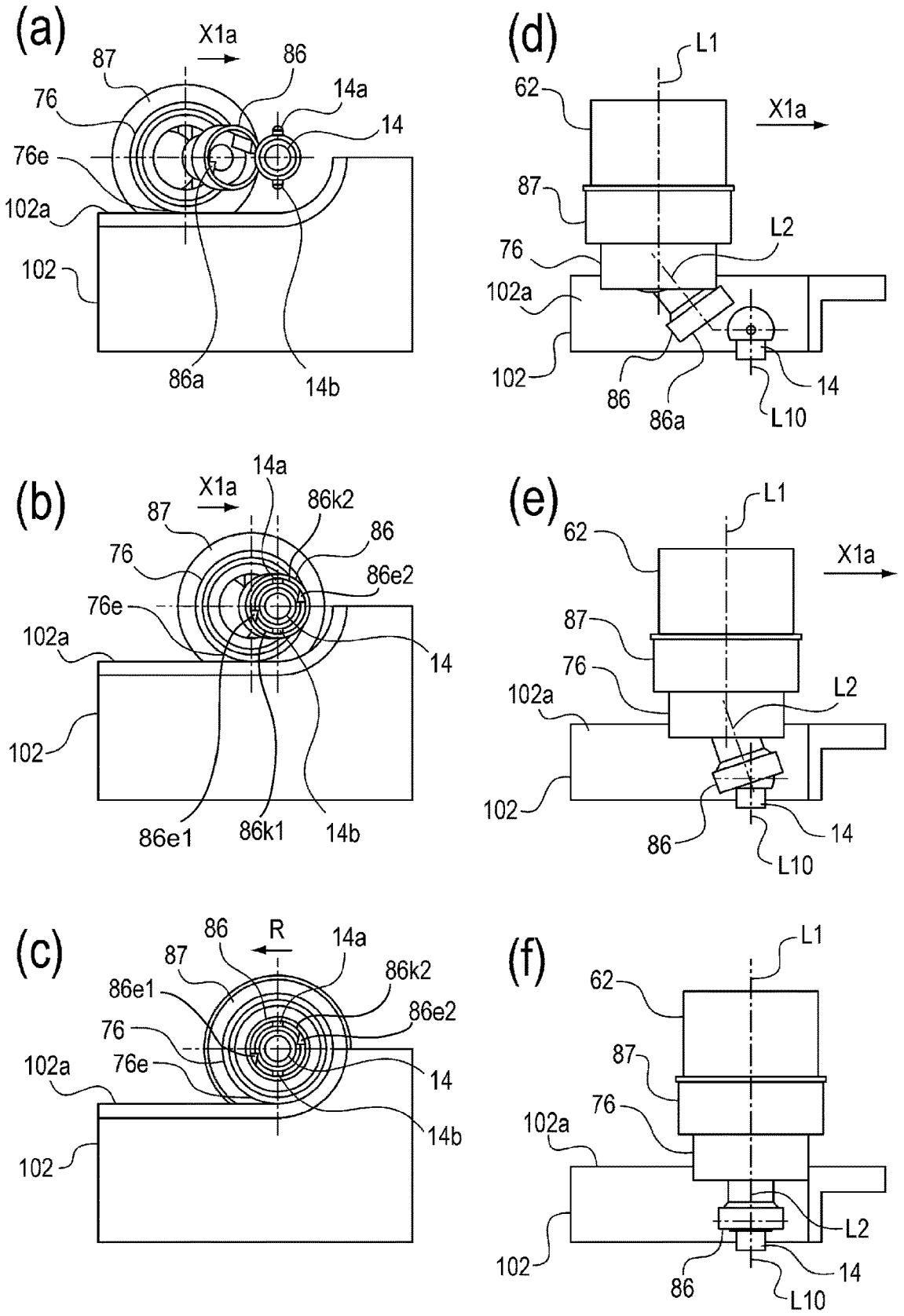
In FIG. 6, (a) to (f) are illustrations showing a state in which a coupling member engages with a main assembly-side engaging portion in the Embodiment 1.

(3) Mounting and Demounting Constitution of Cartridge B Relative to Apparatus Main Assembly A Using FIGS. 5 and 6, a mounting and demounting constitution of the cartridge B relative to the apparatus main assembly A will be described. In FIG. 5, (a) and (b) are illustrations each showing a state in which the cartridge B is mounted in the apparatus main assembly A. In FIG. 6, (a) to (f) are illustrations showing a state in which the cartridge B is mounted in the apparatus main assembly A with an operation of inclination (tilting) of the coupling member 86. In FIG. 6, (a) to (c) are enlarged views when the neighborhood of the coupling member 86 is viewed from a driving side toward non-driving side, and (d) to (f) are schematic views showing states of (a) to (c) of FIG. 6, respectively, as seen from above. The cartridge B is mounted in the order of (a), (b) and (c) of FIG. 6, and (c) of FIG. 6 shows a state of completion of the mounting. In FIG. 6, with respect to the apparatus main assembly A, only a driving-side guide member 102 and a main assembly-side engaging portion 14 are shown. Further, with respect to the cartridge B, only the coupling member 86 constituting a photosensitive drum unit U1, a driving-side flange 87 as a rotational force receiving member, and the photosensitive drum 62 are shown.

As shown in FIG. 5, to the apparatus main assembly A, a main assembly cover 13 is rotatably secured. Further, as shown in (a) of FIG. 5, on the driving side of apparatus main assembly A, the driving-side guide member 102 is provided on a driving-side side plate 108 constituting a casing of the apparatus main assembly A. In addition, the driving-side guide member 102 is provided with a first guide portion 102*a* and a second guide portion 102*b*. Each of the first guide portion 102*a* and the second guide portion 102*b* is formed in a groove shape along a mounting and demounting path X1 (mounting direction X1*a*, demounting direction X1*b*) of the cartridge B, and a driving-side urging member 103 is provided at a terminal end of the first guide portion 102*a* with respect to the mounting direction X1*a*. Here, each of the mounting direction X1*a* and the demounting direction X1*b* is a predetermined direction substantially perpendicular to a rotational axis L10 of the main assembly-side engaging portion 14. Further, with respect to the mounting direction X1*a*, at the terminal end of the first guide portion 102*a*, the main assembly-side engaging portion 14 is provided and supported rotatably relative to the apparatus main assembly A. By engagement between the main assembly-side engaging portion 14 and the coupling member 86, a rotational force transmitted from the apparatus main assembly A to the cartridge B as described specifically later. Similarly, as shown in (b) of FIG. 5, on the non-driving side of apparatus main assembly A, a non-driving side guide member 125 is provided on a non-driving side plate 109 constituting a casing of the apparatus main assembly A. In addition, the non-driving-side guide member 125 is provided with a first guide portion 125*a* and a second guide portion 125*b*. Each of the first guide portion 125*a* and the second guide portion 125*b* is formed in a groove shape along a mounting and demounting path X1 (mounting direction X1*a*, demounting direction X1*b*) of the cartridge B, and a non-driving-side urging member 104 is provided at a terminal end of the first guide portion 125*a* with respect to the mounting direction X1*a*.

On the other hand, as shown in (a) of FIG. 5, on the non-driving side of the cartridge B, the cleaning frame 71 is provided with a portion-to-be-guided 71*e* and a rotation preventing portion 71*d*. Similarly, as shown in (b) of FIG. 5, on the driving side of the cartridge B, the supporting member 76 is provided with a portion-to-be-guided 76*e*, and the cleaning frame 71 is provided with a rotation preventing portion 71*f*.

Here, the mounting and demounting path X1 of the cartridge B is provided along a direction substantially perpendicular to the rotational axis L10 of the main assembly-side engaging portion 14.

Figure 10:
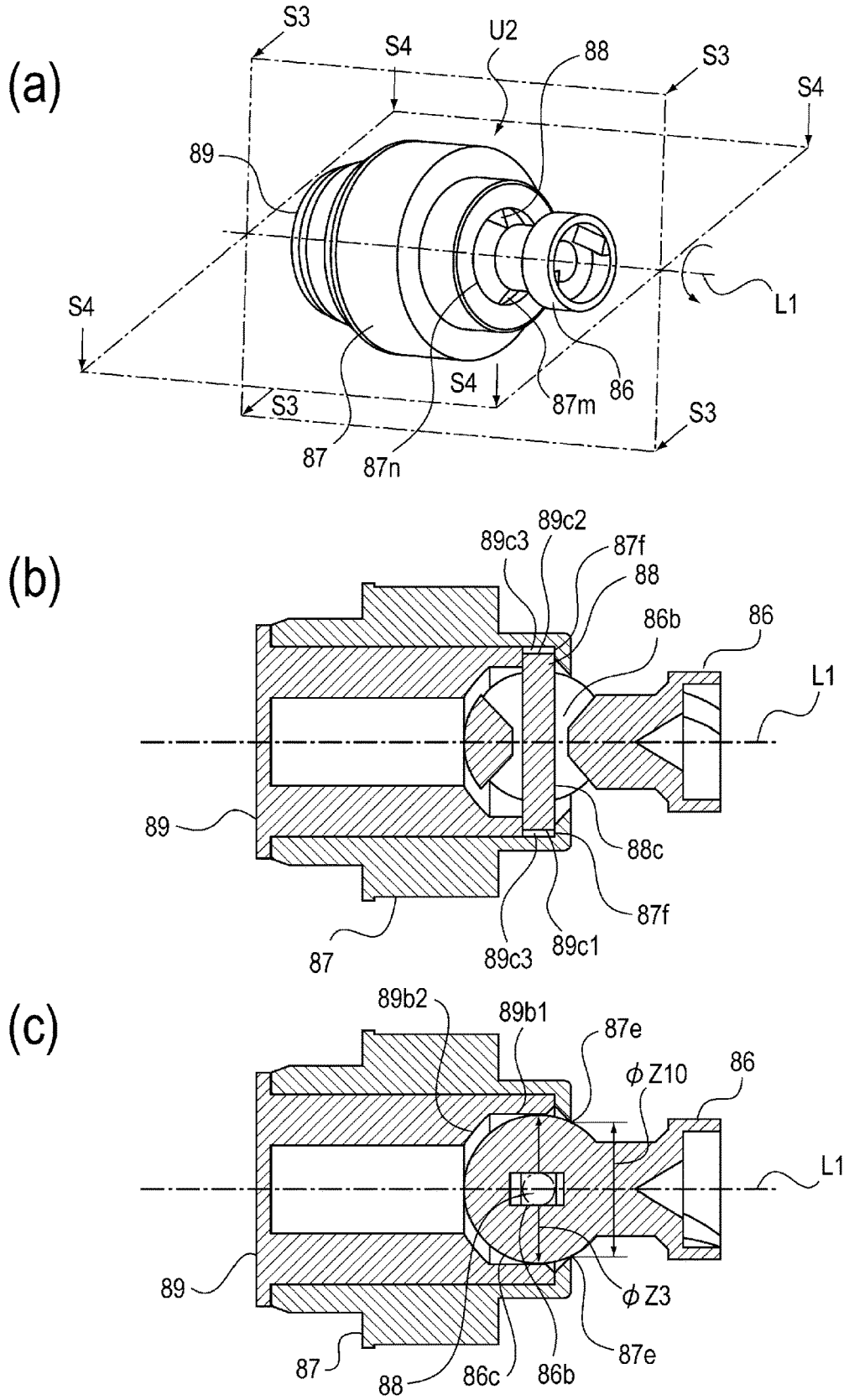
In FIG. 10, (a) to (c) are illustrations each showing a constitution of the driving-side flange unit in the Embodiment 1.

As shown in (a) of FIG. 10, the user rotates the main assembly cover 13 of the apparatus main assembly A in an opening direction X3 and exposes an inside of the apparatus main assembly A. Then, the user grips a gripping portion T of the cartridge B and moves the cartridge B in the mounting direction X1*a*, and then mounts the cartridge B in the apparatus main assembly A. During this mounting process, the portion-to-be-guided 76*e* of the supporting member 76 is supported by the first guide portion 102*a* of the driving-side guide member 102, and the rotation preventing portion 71*f* of the cleaning frame 71 is supported by the second guide portion 102*b* of the driving-side guide member 102. Further, the portion-to-be-guided 71*e* of the cleaning frame 71 is supported by the first guide portion 125*a* of the non-driving-side guide member 125, and the rotation preventing portion 71*d* of the cleaning frame 71 is supported by the second guide portion 125*b*.

Using FIG. 6, a state in which the cartridge B is mounted in the apparatus main assembly A with the operation of inclination (tilting) of the coupling member 86 will be described.

As shown in (a) and (d) of FIG. 6, the cartridge B is inserted into the apparatus main assembly A along the mounting direction X1*a*. At this time, the coupling member 87 is urged by an urging member 91 ((b) of FIG. 8) provided on the supporting member 76 in a direction in which a free end portion 86*a* of the coupling member 86 approaches the main assembly-side engaging portion 14, so that the cartridge B is gradually inserted into the apparatus main assembly A while the coupling member 86 is kept in a state in which the coupling member 86 is directed toward a downstream side with respect to the mounting direction X1*a* as described later specifically. Here, a rotational axis L2 of the coupling member 86 is in an inclined (tilted) state relative to a rotational axis L1 of the driving-side flange 87 as a rotational force receiving member and the rotational axis L10 of the main assembly-side engaging portion 14.

When the cartridge B is further inserted in the mounting direction X1*a*, as shown in (b) and (e) of FIG. 6, a stand-by portion 86*k*1 of the coupling member 86 and a rotational force applying portion 14*b* of the main assembly-side engaging portion 14 are in contact with each other. By this contact, a position of the coupling member 86 is regulated, so that an inclination amount (tilting amount) of the rotational axis 12 relative to the rotational axis L1 and the rotational axis L10 gradually decreases.

When the cartridge B is inserted into a mounting completion position, as shown in (c) and (f) of FIG. 6, the rotational axis L2 is positioned substantially coaxial (in alignment) with the rotational axis L1 and the rotational axis L10. At this time, a state in which the rotational force applying portion 14*b* of the main assembly-side engaging portion 14 is disposed at the stand-by portion 86*k*1 of the coupling member 86 is formed. When the main assembly-side engaging portion 14 rotates, a rotational force receiving portion 86*e*1 of the coupling member 86 and the rotational force applying portion 14*a* of the main assembly-side engaging portion 14 engage with each other. Also a relationship between a rotational force receiving portion 86*e*2 of the coupling member 86 and a rotational force applying portion 14*b* of the main assembly-side engaging portion 14 is similar to the above relationship, and therefore will be omitted from description.

In this way, by engagement of the coupling member 86 with the main assembly-side engaging portion 14, the rotational force can be transmitted from the apparatus main assembly A to the cartridge B.

Incidentally, "substantially coaxial (in alignment) with" includes, in addition to the case where a rotational axis (e.g., L2) is completely coaxial (in alignment) with another rotational axis (e.g., L1, L10), also the case where the rotational axis is somewhat deviated from the coaxial (alignment) state with another rotational axis due to a variation in part (component) dimension. This is true for also the following description.

Figure 8:
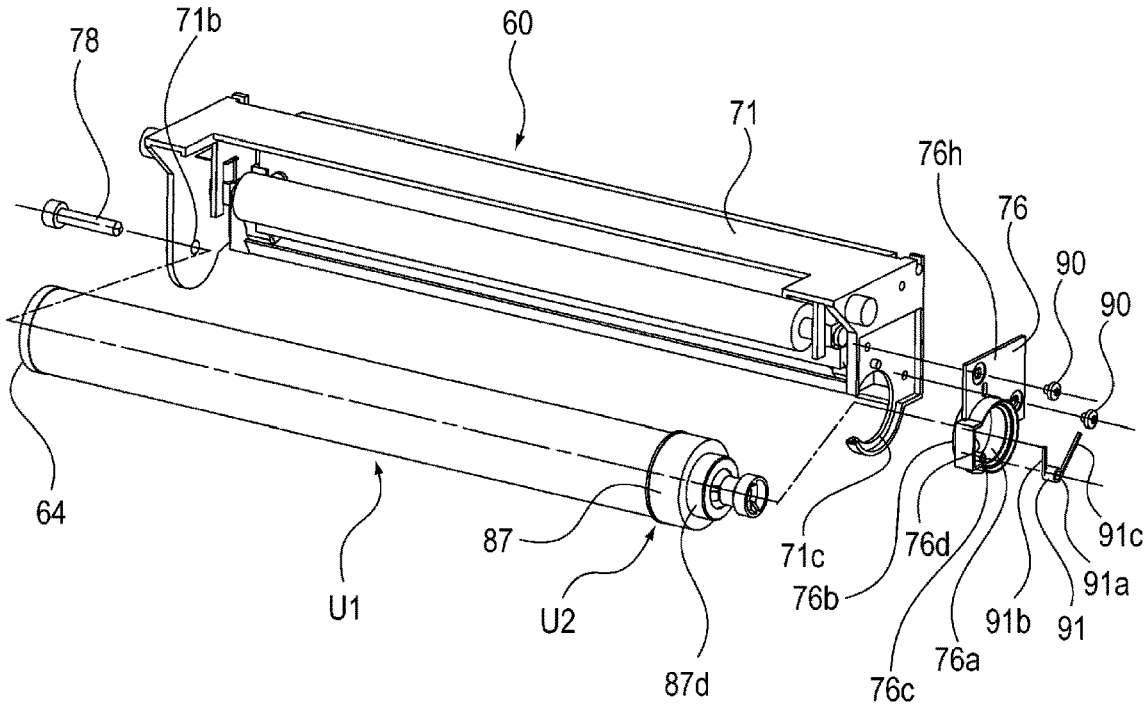
In FIG. 8, (a) and (b) are illustrations each showing a state of a cleaning unit including the photosensitive drum unit in the Embodiment 1.
Figure 8:
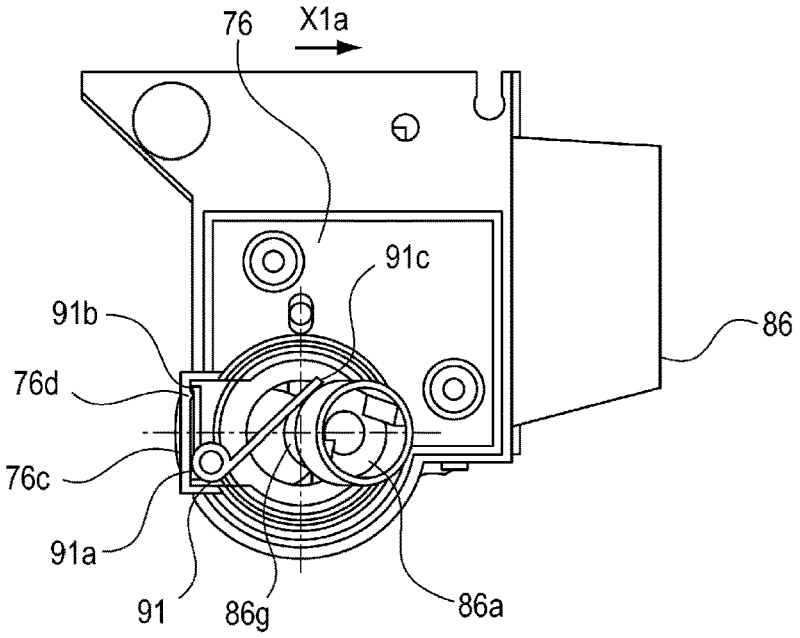

Further, in this embodiment, the constitution in which the free end portion 86*a* of the coupling member 86 is directed by the urging member 91 (*b*) of FIG. 8) in the direction in which the coupling member 86 approaches the main assembly-side engaging portion 14 was employed. However, for example, when the mounting direction X1*a* and a direction of gravity are in a substantially parallel relationship, even if the urging member 91 ((b) of FIG. 8) does not exist, the free end portion 86*a* of the coupling member 86 can be directed in the mounting direction X1*a*. In such a case, the urging member 91 ((b) of FIG. 8) may also be omitted (removed).

Further, in place of the urging member 91 ((b) of FIG. 8), the apparatus main assembly A may also be provided with such a constitution that the free end portion 86*a* of the coupling member 86 is moved toward the main assembly-side engaging portion 14.

By the operation described above, the cartridge B is positioned in the apparatus main assembly A, so that the mounting operation of the cartridge B into the apparatus main assembly A is completed. On the other hand, when the cartridge B is demounted from the apparatus main assembly A, the demounting operation is performed by the user in a reverse process to the mounting process of the cartridge B while the user grips the gripping portion T, and therefore will be omitted from description. The coupling member 86 is changed in state from (c) and (f) of FIG. 6 to (a) and (d) of FIG. 6, so that the rotational axis L2 of the coupling member 86 is inclined (tilted) relative to the rotational axes L1 and L10, and thus the coupling member 86 is demounted from the main assembly-side engaging portion 14. That is, the cartridge B is moved in the demounting direction X1*b* opposite to the mounting direction X1*a*, so that the coupling member 86 is disengaged (demounted) from the main assembly-side engaging portion 14.

In this embodiment, the mounting and demounting path X1 was described as a path provided linearly with respect to a direction substantially perpendicular to the rotational axis L10 of the main assembly-side engaging portion 14, but is not limited thereto. The mounting and demounting path X1 may also be a combination of rectilinear lines or a curved path.

In this embodiment, the constitution in which the cartridge B moves in the direction substantially perpendicular to the rotational axis L10 of the main assembly-side engaging portion along the mounting and demounting path X1 was described, but is not limited thereto. Only in the neighborhood of the mounting completion position, the cartridge B moves in the direction substantially perpendicular to L10 of the main assembly-side engaging portion 14, and at places other than the neighborhood of the mounting completion position, the cartridge B may move in any direction. That is, at the time when the coupling member 86 is engaged with or disengaged from the main assembly-side engaging portion 14, the coupling member 86 may only be required to move in a predetermined direction substantially perpendicular to the rotational axis L10 of the main assembly-side engaging portion 14.

(4) Photosensitive Drum Unit U1

Figure 7:
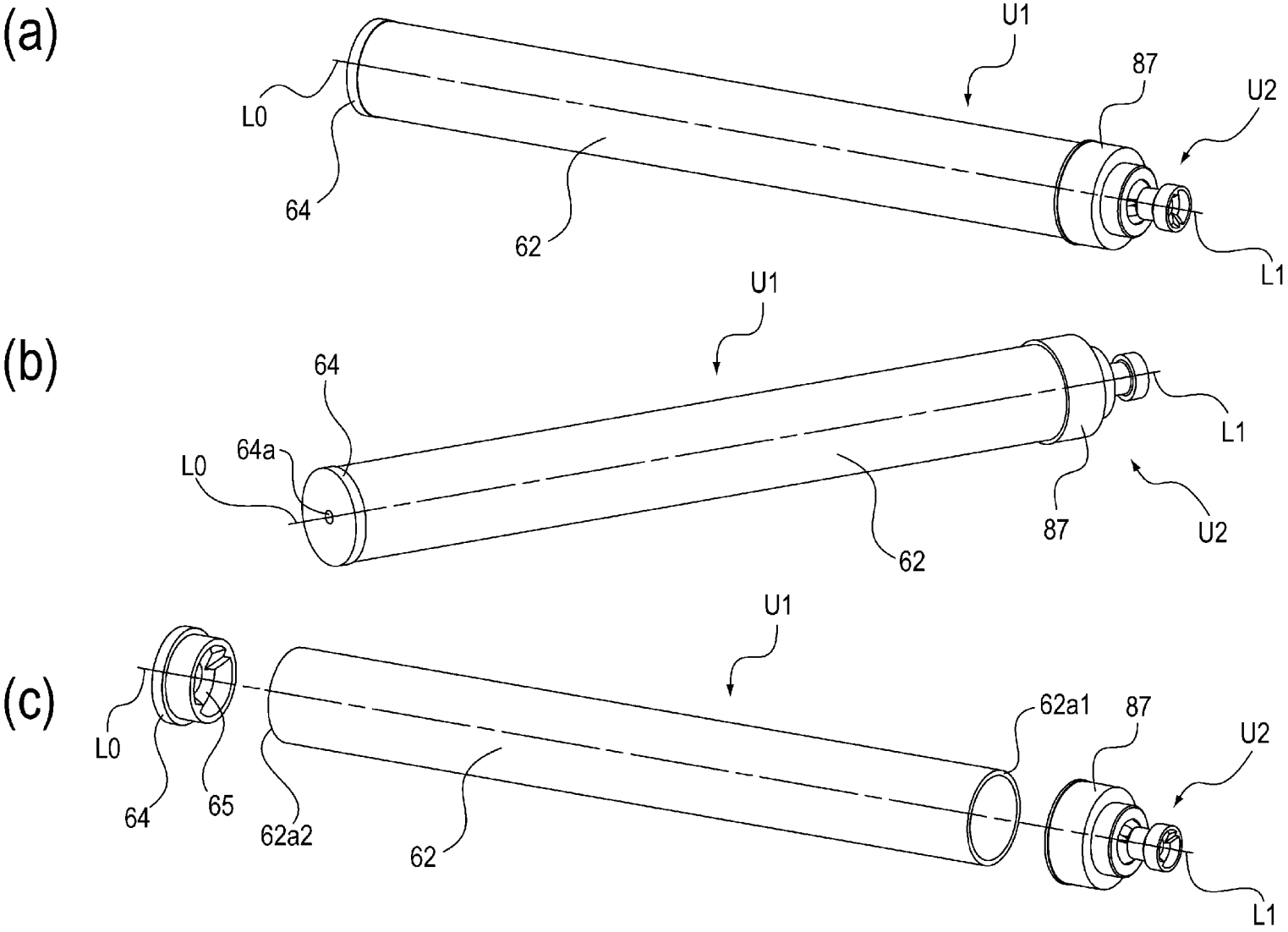
In FIG. 7, (a) to (c) are illustrations each showing a constitution of a photosensitive drum unit in the Embodiment 1.

Using FIGS. 7 and 8, a constitution of the photosensitive drum unit U1 will be described. In FIG. 8, (a) and (b) are illustrations each showing the constitution of the photosensitive drum unit U1. In FIG. 7, (a) is a perspective view of the photosensitive drum unit U1 as seen from the driving side, (b) is a perspective view of the photosensitive drum unit U1 as seen from the non-driving side, and (c) is an exploded perspective view of the photosensitive drum unit U1. In FIG. 8, (a) is an illustration showing a state in which the photosensitive drum unit U1 is assembled into the cleaning unit 60, and (b) is a side view of the cleaning unit 60 as seen from the driving side.

As shown in FIG. 7, the photosensitive drum unit U1 is constituted by the photosensitive drum 62, a driving-side flange unit U2 as a photosensitive drum drive transmission unit, a non-driving-side flange 64 and a grounding plate 65.

The photosensitive drum 62 is an electroconductive member, such as aluminum, having a surface coated with a photosensitive layer. The inside of the photosensitive drum 62 may be hollow or solid.

The driving-side flange unit U2 is disposed at a driving-side end portion of the photosensitive drum 62. Specifically, as shown in (c) of FIG. 7, with respect to the driving-side flange unit U2, a portion-to-be-fixed 87*b* of the driving-side flange 87 which is the rotational force receiving member engages with an opening 62*a*1 of the photosensitive drum 62 at a longitudinal end portion of the photosensitive drum 62, so that the driving-side flange unit U2 is fixed to the photosensitive drum 62 by bonding, caulking or the like. When the driving-side flange 87 rotates, the photosensitive drum 62 rotates integrally with the driving-side flange 87. The driving-side flange 76 is fixed to the photosensitive drum 62 so that the rotational axis L1 thereof and the rotational axis L0 of the photosensitive drum 62 are substantially coaxial (in alignment) with each other.

Similarly, the non-driving-side flange 64 is disposed substantially coaxially with the photosensitive drum 62 at a non-driving-side end portion of the photosensitive drum 62. As shown in (c) of FIG. 7, the non-driving-side flange 64 is fixed to the photosensitive drum 62 by bonding, caulking or the like. The non-driving-side flange 64 is provided with an electroconductive (principally metal) grounding plate 65. The grounding plate 65 contacts an inner peripheral surface of the photosensitive drum 62 and is electrically connected with the photosensitive drum 62 and the apparatus main assembly A via electrical contacts (not shown).

As shown in (a) of FIG. 8, the photosensitive drum unit U1 is supported by the cleaning unit 60. On the non-driving side of the photosensitive drum unit U1, a bearing portion 64*a* ((b) of FIG. 7) of the non-driving-side flange 64 is rotatably supported by a drum shaft 78. The drum shaft 78 is press-fitted and fixed in a supporting portion 71*b* provided in the cleaning frame 71 on the non-driving side. On the other hand, on the driving side of the photosensitive drum unit U1, a portion-to-be-supported 87*d* of the driving-side flange 87 is rotatably supported by a supporting portion 76*a* of the supporting member 76. Further, with respect to the supporting member 76, a positioning portion 76*b* is inserted into a supporting portion 71*c* of the cleaning frame 71, a wall surface 76*h* as a base portion (portion-to-be-fixed) of the supporting member 76 is secured to the cleaning frame 71 with screws 90. As a result, the supporting member 76 is fixed to the cleaning frame 71. Further, the driving-side flange 87 is supported by the cleaning frame 71 via the supporting member 76.

In this embodiment, a constitution in which the supporting member 76 is fixed to the cleaning frame 71 by the screws 90 is employed, but a fixing constitution by bonding or a bonding constitution using a method resin material may also be employed. Further, the cleaning frame 71 and the supporting member 76 may also be integrated with each other.

The supporting member 76 is provided with the urging member 91 for inclining the coupling member 86. Specifically, as shown in (b) of FIG. 8, the urging member 91 is formed with a torsion coil spring, and a portion-to-be-supported 91*a* of the urging member 91 is fixed to the supporting portion 76*c* of the supporting member 76. Further, the urging member 91 is disposed so that a fixed and portion 91*b* of the urging member 91 contacts a fixing portion 76*d* of the supporting member 76 and so that a free end portion 91*b* of the urging member 91 contacts a connecting portion 86*g* of the coupling member 86. In this state, the fixed end portion 91*b* and the free end portion 91*c* of the urging member 91 is held in such a state that these portions are compressed between the fixing portion 76*d* and the connecting portion 86*g*. As a result, the free end portion 91*c* urges the connecting portion 86*g*, so that the coupling member 86 is inclined. The coupling member 86 inclines so that the free end portion 86*a* is directed toward a downstream side with respect to the mounting direction X1*a*.

(5) Driving-Side Flange Unit U2

Figure 9:
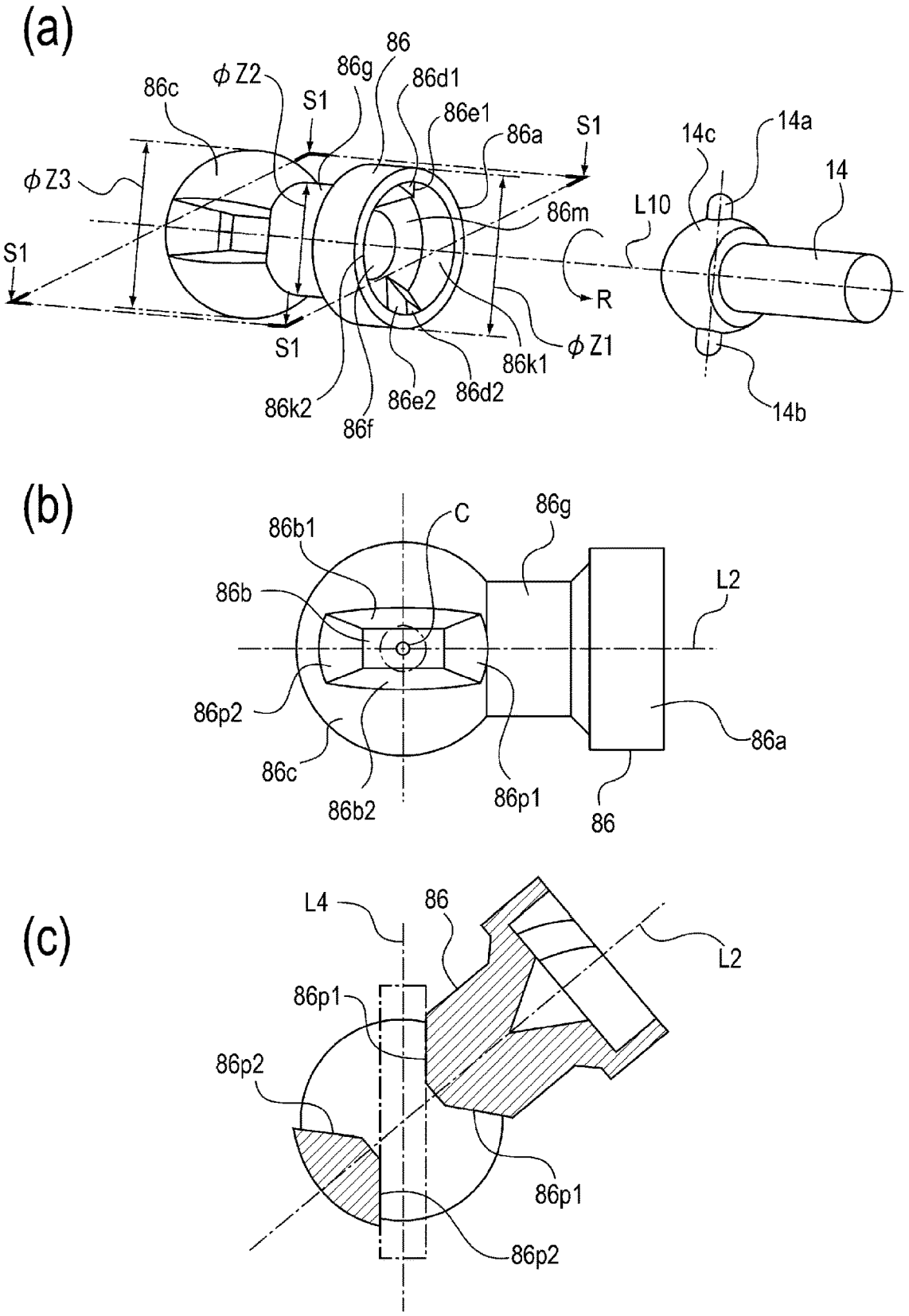
In FIG. 9, (a) to (c) are illustrations each showing a constitution of the coupling member in the Embodiment 1.

Using FIGS. 1, 9 and 10, a constitution of the driving-side flange unit U2 will be described. In FIG. 1, (a) is an exploded perspective view of the photosensitive drum flange unit U2 on the driving side, and (b) is a sectional view of a preventing member 89 cut along a flat plane S2 in (a) of FIG. 1. In FIG. 9, (a) is a perspective illustration of the coupling member 86, (b) is a schematic view of the coupling member 86 as seen from a direction perpendicular to the axis L2 in (a) of FIG. 9, and (c) is a sectional view of the coupling member 86 cut along a flat plane S1 in (a) of FIG. 9. In FIG. 10, (a) to (c) are illustrations each showing a constitution of the driving-side flange unit U2, wherein (a) is a perspective view of the driving-side flange unit U2, (b) is a sectional view of the driving-side flange unit U2 cut along a flat plane S3 in (a) of FIG. 10, and (c) is a sectional view of the driving-side flange unit U2 cut along a flat plane S4 in (a) of FIG. 10.

Using (a) of FIG. 10, constituent elements (parts) of the driving-side flange unit U2 will be described. The driving-side flange unit U2 includes the coupling member 86, a pin 88 as a shaft portion, the preventing member 89 and the driving-side flange 87 as the rotational force receiving member.

The coupling member 86 principally includes 3 (first to third) portions. The first portion is the free end portion 86*a* for receiving the rotational force from the main assembly-side engaging portion 14 in engagement with the main assembly-side engaging portion 14. The second portion is the connecting portion 86*c* which is substantially spherical in shape and which is connected (coupled) with the preventing member 89. The third portion is the connecting portion 86*g* connecting the free end portion 86*a* and the connecting portion 86*c*.

In this embodiment, a diameter φZ2 of the connecting portion 86*g* is smaller than a diameter φZ1 of the free end portion 86*a* and is smaller than a diameter φZ3 of the connecting portion 86*c*. The diameter φZ1 is smaller than the diameter φZ3. The connecting portion 86*g* has a circular column shape (cylindrical shape) substantially along with the rotational axis L2.

The free end portion 86*a* is, as shown in FIG. 9, provided with an opening 86*m* spreading relative to the rotational axis L2 of the coupling member 86. The opening 86*m* is provided with a conical-shaped receiving surface 86*f* as a spreading portion spreading toward the main assembly-side engaging portion 14. The receiving surface 86*f* is a recessed shape. The opening 86*m* is provided on an opposite side with respect to the receiving surface 86*f* from a side where the photosensitive drum 62 is provided along the direction of the rotational axis L2.

Further, on a free end side of the free end portion 86*a* and on the circumference of a circle with the rotational axis L2 as a center, two projections 86*d*1, 86*d*2 are provided. The projections 86*d*1, 86*d*2 are disposed at point-symmetrical positions with respect to the rotational axis L2 so as to project toward the rotational axis L2. Further, between the projections 86*d*1, 86*d*2, stand-by portions 86*k*1, 86*k*2 are provided. Here, with respect to a radial direction of the coupling member 86, the receiving surface 86*f* is constituted so as to be positioned inside the two projections 86*d*1, 86*d*2. During stand-by for transmission of the rotational force from the main assembly-side engaging portion 14 to the coupling member 86, the rotational force applying portions 14*a*, 14*b* are positioned at the stand-by portions 86*k*1, 86*k*2, Further, the projections 86*d*1, 86*d*2 are provided with rotational force receiving portions 86*e*1, 86*e*2, respectively, crossing an R direction, which is a cartridge rotational direction, on an upstream side with respect to the R direction.

In a state in which the coupling member 86 and the main assembly-side engaging portion 14 engage with each other and the main assembly-side engaging portion 14 rotates, the rotational force applying portions 14*a*, 14*b* contact the rotational force receiving portions 86*e*1, 86*e*2. As a result, the rotational force is transmitted from the main assembly-side engaging portion 14 to the coupling member 86.

The connecting portion 86*c* is, as shown in (b) of FIG. 9, constituted in a substantially spherical shape having a center C as a tilting center substantially on the rotational axis L2.

The connecting portion 86*c* is provided with a hole 86*b* which is a through hole penetrating in a perpendicular direction substantially perpendicular to the rotational axis L2. This hole 86*b* is constituted by rotational force transmitting portions 86*b*1, 86*b*2 parallel to the rotational axis L2, a first inclination-regulated portion 86*p*1 and a second inclination-regulated portion 86*p*2. Using (c) of FIG. 9, the first and second inclination-regulated portions 86*p*1, 86*p*2 will be described specifically. Around an axis substantially perpendicular to both of an axis L4 of the pin 88 and the rotational axis L2 of the coupling member 86, the coupling member 86 is inclined relative to the pin 88. At that time, the first and second inclination-regulated portions 86*p*1, 86*p*2 contacts an outer peripheral portion 88*c* of the pin 88, so that ion of the coupling member 86 relative to the pin 88 is regulated. On the other hand, the coupling member 86 is inclined relative to the pin 88 also around the axis L4 of the pin 88. At that time, the connecting portion 86*g* of the coupling member 86 contacts an inclination-regulating portion 87*n* ((a) of FIG. 1) provided in the driving-side flange 87, so that inclination of the coupling member 86 around the axis L4 is regulated.

A material for the coupling member 86 in this embodiment is a resin material such as polyacetal, polycarbonate, PPS, a liquid crystal polymer or the like. However, in order to enhance rigidity of the coupling member 86, depending on a load torque, glass fibers, carbon fibers or the like may also be added in the above resin material. In the case where the fibers are added in the resin material, it is possible to enhance the rigidity of the coupling member 86. Further, by insertion of metal into the resin material, the rigidity may also be further enhanced, and the coupling member 86 may also be prepared by metal or the like as a whole.

Further, the free end portion 86*a*, the connecting portion 86*c* and the connecting portion 86*g* may be integrally molded or may also integrally connected after being formed as separate members.

The pin 88 is, as shown in (a) of FIG. 1, substantially circular column (or cylinder) in shape, and is disposed with respect to a direction substantially perpendicular to the rotational axis L1.

The preventing member 89 is provided with a base portion 89*a* which is a disk in shape and a projected portion 89*b* which projects from the base portion 89*a* substantially parallel to and along the rotational axis L3 of the preventing member 89 and which is a cylinder in shape. The base portion 89*a* is provided with a connecting portion 89*a*1 for connecting with the driving-side flange 87. Inside the projected portion 89*b*, a first supporting portion 89*b*1 extending along the rotational axis L3 and a conical-shaped second supporting portion 89*b*2 provided closer to the base portion 89*a* than the first supporting portion 89*b*1 is with respect to the rotational axis L1. The preventing member 89 is provided with an accommodating portion surrounded by the first supporting portion 89*b*1 and the second supporting portion 89*b*2. Further, the preventing member 89 is provided with a pair of groove portions 89*c* substantially parallel to the rotational axis L3 of the projected portion 89*b*. The pair of groove portions 89*c* is disposed so as to be shifted in phase by about 180 deg. around the rotational axis L3 of the projected portion 89*b*. Further, as shown in (b) of FIG. 1, each of the groove portions 89*c* is constituted by a rotational force receiving portion 89*c*1 substantially parallel to the rotational axis L3 of the projected portion 89*b*, a rotation preventing portion 89*c*2, and a preventing portion 89*c*3 substantially perpendicular to the rotational axis L3 of the projected portion 89*b*. The preventing portion 89*c*3 is positioned on the non-driving side (the other side with respect to the axial direction) of the groove portion 89*c* with respect to the rotational axis L1 and is open on the driving side (one side with respect to the axial direction) of the groove portion 89*c*.

The driving-side flange 87 is, as shown in (a) of FIG. 1, provided with a connecting portion 87*a*, a portion-to-be-fixed 87*b*, a gear portion (helical gear or spur gear) 87*c*, and a portion-to-be-supported 87*d*. The connecting portion 87*a* is a portion connecting with the connecting portion 89*a*1 of the preventing member 89. The portion-to-be-fixed 87*b* is a portion to be fixed to the photosensitive drum 62 in contact with the photosensitive drum 62. The gear portion 87*c* is a portion for transmitting the rotational force to the developing roller 32 (FIG. 4). The portion-to-be-supported 87*d* is a portion to be supported by the supporting portion 76*a* ((a) of FIG. 8) of the supporting member 76. These portions are disposed coaxially with the rotational axis L0 of the photosensitive drum 62. Incidentally, the rotational axis L1 of the driving-side flange 87 is provided substantially in parallel to the rotational axis L3 of the preventing member 89.

Further, the driving-side flange 87 has a hollow shape and includes an accommodating portion 87*i* therein. Here, the accommodating portion 87*i* is a portion for accommodating therein the connecting portion 86*c* of the coupling member 86, the pin 88 and the projected portion 89*b* of the preventing member 89. Further, the accommodating portion 87*i* prevents, on the driving side thereof, the coupling member 86 and the pin 88 from dropping (falling) out toward the driving side.

In this embodiment, the driving-side flange 87 is molded with a resin material by injection molding, and a material for the driving-side flange 87 is polyacetal, polycarbonate or the like. However, depending on a load torque for rotating the photosensitive drum 62, the driving-side flange 87 may also be formed of metal.

Using (a) and (b) of FIG. 1, an assembling method of the driving-side flange unit U2 will be described.

First, the pin 88 is inserted into the hole 86*b* of the coupling member 86. Then, a phase of the pin 88 is aligned with a phase of the pair of groove portions 89*c* of the preventing member 89 so that the pin 88 is engaged in the pair of groove portions 89*c*. Then, the coupling member 86 and the pin 88 are inserted together into the accommodating portion 89*b*3 along the rotational axis L1. At this time, the connecting portion 86*c* of the coupling member 86 is supported by the first supporting portion 89*b*1 of the preventing member 89, so that the coupling member 86 is prevented from moving in a direction substantially perpendicular to the rotational axis L1. Further, the rotational force transmitting portions 88*a*1, 88*a*2 of the pin 88 are sandwiched between the rotational force receiving portion 89*c*1 and the rotation preventing portion 89*c*2 which from the groove portion 89*c* of the preventing member 89, so that the pin 88 is prevented from moving in the rotational direction R of the photosensitive drum 62.

Next, the coupling member 86, the pin 88 and the preventing member 89 are inserted together into the accommodating portion 87*i* of the driving-side flange 87 from the non-driving side along the rotational axis L1. On the other hand, on the driving side of the driving-side flange 87, an opening 87*m* is provided. A diameter φZ10 of the opening 87*m* is provided so as to be larger than the diameter φZ1 of the free end portion 86*a* and the diameter φZ2 of the connecting portion 86*g*. As a result, the free end portion 86*a* and a part of the connecting portion 86*g* of the coupling member 86 pass through the opening 87*m* and can be disposed outside the accommodating portion 87*i* on the driving side. In this state, the connecting portion 89*a*1 of the preventing member 89 and the connecting portion 87*a* of the driving-side flange 87 can be fixed to each other by welding or bonding. At this time, the connecting portion 89*a*1 of the preventing member 89 and the connecting portion 87*a* of the driving-side flange 87 are connected with each other in a broad range around the rotational axis L1. As a result, the coupling member 86 and the pin 88 are connected with the driving-side flange 87 via the preventing member 89.

As shown in (b) of FIG. 10, a second retaining portion 87*f* is provided in the accommodating portion 87*i* on the driving side. Then, an outer peripheral portion 88*c* of the pin 88 contacts the second retaining portion 87*f* of the driving-side flange 87 and the preventing portion 89*c*3 of the preventing member 89, so that the pin 88 is prevented from moving in a direction (longitudinal direction) parallel to the rotational axis L1.

As shown in (c) of FIG. 10, the opening 87*m* is formed by a first retaining portion 87*e* for preventing dropping-off of the coupling member 86 and the inclination regulating portion 87*n* for regulating the inclination of the coupling member 86 in contact with the connecting portion 86*g* when the coupling member 86 is inclined (tilted). Here, the first retaining portion 87*e* may also have a conical shape with the rotational axis L1 as a center axis, or a spherical surface, or may also be a flat plane crossing the rotational axis L1. The diameter φZ10 of the opening 87*m* is provided so as to be smaller than a diameter φZ3 of the connecting portion 86*c*. Therefore, the connecting portion 86*c* of the coupling member 86 contacts the first retaining portion 87*e* forming the opening 87*m*, so that the coupling member 86 is prevented from dropping out on the driving side of the accommodating portion 87*i*. Further, the connecting portion 86*c* of the coupling member 86 contacts the second supporting portion 89*b*2 of the preventing member 89, so that the coupling member 86 is prevented from dropping out on the non-driving side of the accommodating portion 87*i*.

The hole 86*b* and the pin 88 are set so as to permit tilting of the coupling member 86, so that the coupling member 86 is capable of inclining (tilting, swinging) in any direction relative to the driving-side flange 87.

(6) Transmission Constitution of Rotational Force from Main Assembly-Side Engaging Portion 14 to Photosensitive Drum 62

Figure 11:
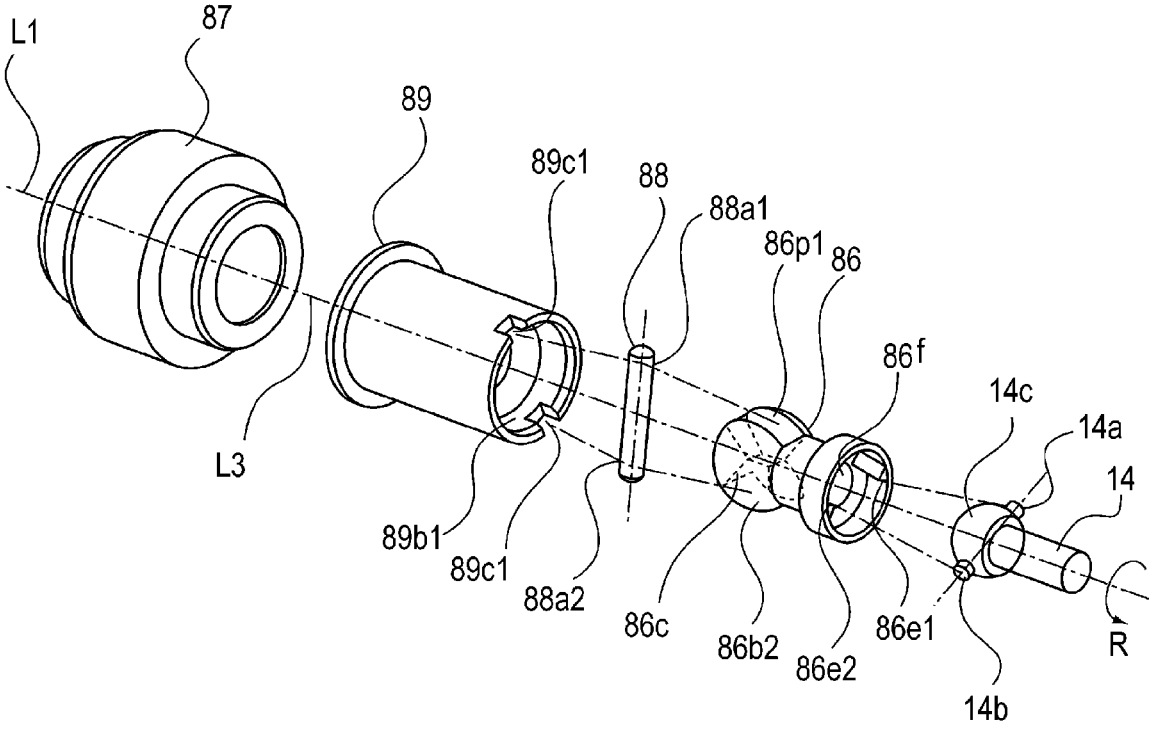
FIG. 11 is an illustration showing a state in which a rotational force is transmitted from a main assembly-side engaging portion to a rotational force receiving member in the Embodiment 1.

Using FIG. 11, a constitution in which the rotational force is transmitted from the main assembly-side engaging portion 14 to the photosensitive drum 62 will be described. FIG. 11 is an exploded perspective view showing a rotational force transmitting path.

As shown in FIG. 11, in a state in which the rotational axis L10 of the main assembly-side engaging portion 14 and the rotational axis L1 of the driving-side flange 87 are disposed substantially coaxially with each other, when the rotational force is transmitted from the driving source of the apparatus main assembly A to the main assembly-side engaging portion 14, the main assembly-side engaging portion 14 rotates in a normal rotational direction. The rotational direction of the main assembly-side engaging portion 14 and the rotational direction R of the photosensitive drum 62 are the same. The rotational force applying portions 14*a*, 14*b* contact the rotational force receiving portions 86*e*1, 86*e*2. Then, the rotational force transmitting portions 86*b*1, 86*b*2 of the coupling member 86 contact the outer peripheral portion 88*c* of the pin 88. Then, the rotational force transmitting portions 88*a*1, 88*a*2 of the pin 88 contact the rotational force receiving portion 89*c*1 of the preventing member 89. The preventing member 89 and the driving-side flange 87 are fixed and therefore integrally rotate, and also the driving-side flange 87 and the photosensitive drum 62 are fixed and therefore integrally rotate. Accordingly, the rotational force of the driving source of the apparatus main assembly A is transmitted to the photosensitive drum 62 from the main assembly-side engaging portion 14 through the coupling member 86, the pin 88, the preventing member 89 and the driving-side flange 87 in the listed order.

Due to a variation in part (component) dimension or the like, in some cases, the rotational axis L10 of the main assembly-side engaging portion 14 and the rotational axis L1 of the driving-side flange 87 are disposed so s to be somewhat shifted (deviated) from a coaxial state in which these axes completely coincide with each other. However, the connecting portion 86*c* of the coupling member 86 is supported by the first supporting portion 89*b*1 of the preventing member 89 so that the rotational axis L2 can incline in all directions relative to the rotational axis L1. Therefore, even in such a case, the coupling member 86 rotates while the rotational axis L2 inclines relative to the rotational axis L1, so that the rotational force is transmitted from the main assembly-side engaging portion 14 to the coupling member 86.

As described above, in this embodiment, by the preventing portion 89*c*3 constituting the groove portion 89*c* of the preventing member 89 and the second retaining portion 87*f* of the driving-side flange 87, the movement of the pin 88 in the longitudinal direction was prevented. Further, by the rotational force receiving portion 89*c*1 and the rotation preventing portion 89*c*2 which constitute the groove portion 89*c* of the preventing member 89, the movement of the pin 88 in the rotational direction R was prevented. Further, by the first supporting portion 89*b*1 constituting the accommodating portion 89*b*3 of the preventing member 89, the movement of the coupling member 86 in the direction substantially perpendicular to the rotational axis of the driving-side flange 87 was prevented. In addition, by the second supporting portion 89*b*2 constituting the accommodating portion 89*b*3 of the preventing member 89, the movement of the coupling member 86 from the driving side to the non-driving side. Further, by the first retaining portion 87*e* of the driving-side flange 87, the movement of the coupling member 86 from the non-driving side to the driving side was prevented. As a result, without proving the driving-side flange 87 with a groove-shaped portion, the coupling member 86 and the pin 88 were connected with the driving-side flange 87 via the preventing member 89.

In a conventional constitution, the rotational force transmitted from the coupling member to the pin is received by the groove-shaped portion of the driving-side flange, but depending on a magnitude of the rotational force, there is a possibility that not only the groove-shaped portion of the driving-side flange but also the driving-side flange itself are largely deformed. As a result, with respect to the driving-side flange, there is a possibility that the portion-to-be-supported where the driving-side flange is rotatably supported and the gear portion or the like for transmitting the rotational force to the developing roller are deformed. As a result, the driving-side flange rotates in a distorted state and engagement of the gear portion during rotation becomes unstable, so that there is a possibility that accurate rotation is impaired. However, according to the constitution of this embodiment, the rotational force transmitted from the coupling member 86 to the pin 88 is received by the groove portion 89*c* of the preventing member 89. Further, the connecting portion 89*a*1 of the preventing member 89 and the connecting portion 87*a* of the driving-side flange 87 are connected with each other in a broad range around the rotational axis L1, so that the rotational force received by the groove portion 89*c* is transmitted from the connecting portion 89*a*1 of the preventing member 89 to the connecting portion 87*a* of the driving-side flange 87. Assuming that the groove portion 89*c* of the preventing member 89 is deformed by the rotational force, the preventing member 89 is connected with the driving-side flange 87 at the connecting portion 89*a*1 different from the deformed groove portion 89*c*, so that the deformation of the groove portion 89*c* does not readily affect the driving-side flange 87. Further, localization of transmission of the rotational force from the preventing member 89 to the driving-side flange 87 around the rotational axis L1 is eliminated. Therefore, deformation of the driving-side flange 87 can be suppressed. Accordingly, compared with the conventional constitution, the driving-side flange rotates with high accuracy and the engagement of the gear portion 87*c* is stable, so that it is possible to smoothly transmit the rotational force from the driving-side flange to the photosensitive drum 62 and the developing roller 32.

Further, in the conventional constitution, the phase where the driving-side flange is provided with the groove-shaped portion around the rotational axis L1 and the phase where there is no groove-shaped portion exist in mixture, and therefore the shape of the driving-side flange was complicated. However, according to the constitution in this embodiment, the driving-side flange 87 has no groove shape, and therefore the shape of the driving-side flange 87 can be made the same around the rotational axis L1. Accordingly, the resin material becomes easily flow uniformly when the driving-side flange 87 is molded by injection molding, and therefore a molding property of the driving-side flange 87 is improved, so that part (component) accuracy of the driving-side flange 87 is improved.

Further, in some cases, a method of fixing the driving-side flange 87 to the photosensitive drum 62 by caulking is used, but when the caulking is made, a strong force is exerted on the driving-side flange 87 from a direction substantially perpendicular to the rotational axis of the driving-side flange 87. In the conventional constitution, the groove-shaped portion of the driving-side flange acts as a trigger, so that there is a possibility that the driving-side flange is largely deformed. Alternatively, there is a need to provide a reinforcing shape for suppressing the deformation of the driving-side flange, so that there is a possibility that the shape of the driving-side flange becomes complicated. However, according to the constitution in this embodiment, the driving-side flange 87 has no groove shape, and therefore, the driving-side flange 87 can be reinforced by a simple-shaped portion.

In this embodiment, the constitution in which the driving-side flange 87 is provided with the first retaining portion 87*e* for preventing the coupling member 86 from moving substantially in parallel to the axis L1 and the second retaining portion 87*f* for preventing the pin 88 from moving substantially in parallel to the axis L1 was employed. However, the pin 88 is inserted into the hole 86*b* of the coupling member 86, and therefore the first retaining portion 87*e* may also be removed (eliminated) and by the pin 88, the movement of the coupling member 86 in the direction of the axis L1 may also be prevented.

Figure 12:
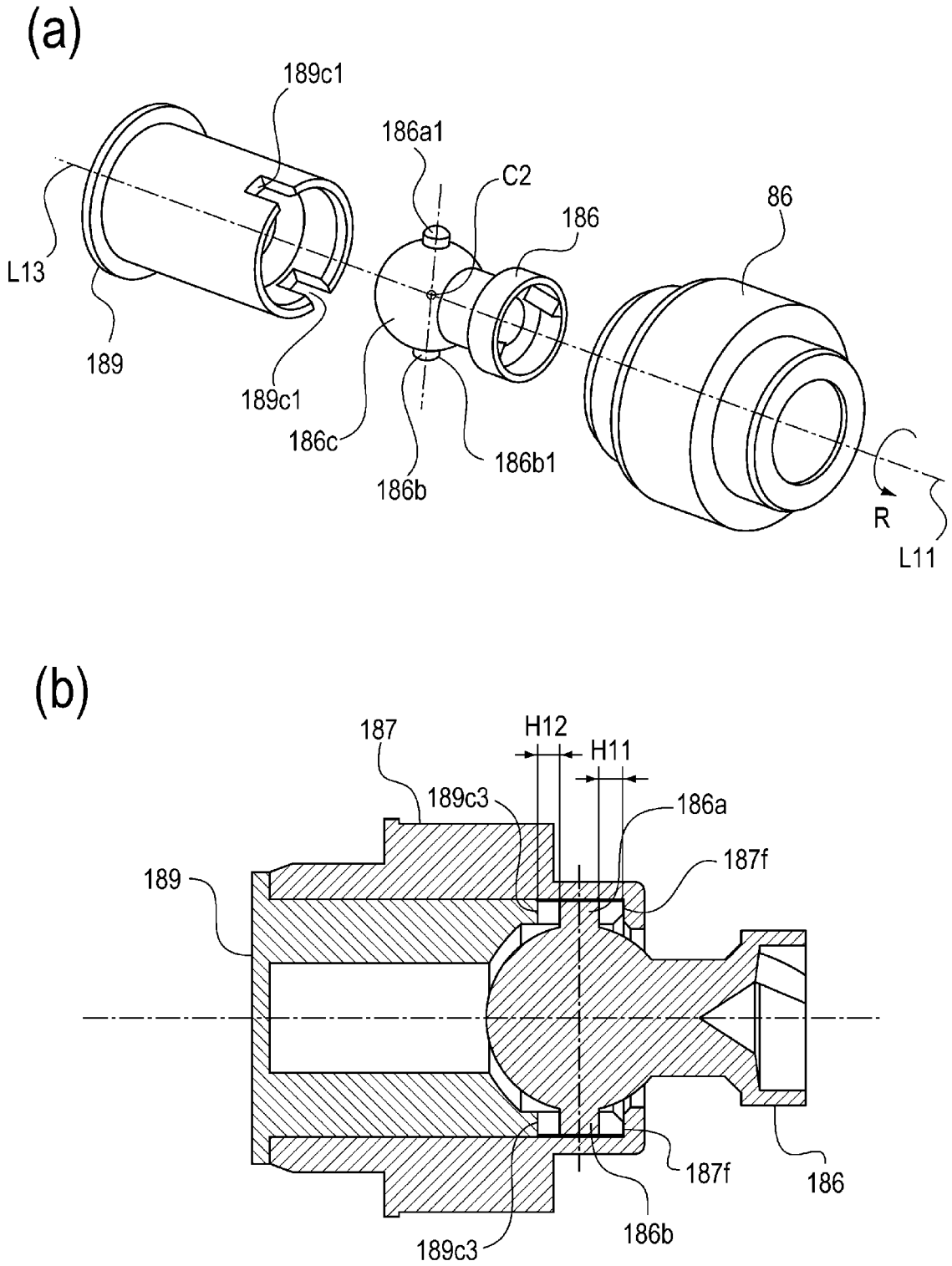
In FIG. 12, (a) and (b) are illustrations each showing a constitution of the coupling member in the Embodiment 1.

In this embodiment, the coupling member 86 and the pin 88 were described as separate members, but the present invention is not limited thereto. For example, as shown in (a) of FIG. 12, a similar effect can be obtained even in a constitution in which a connecting portion 186*c* of a coupling member 186 is provided with shaft portions 186*a*, 186*b*. In this case, the shaft portions 186*a*, 186*b* are disposed substantially coaxially with each other so that axes of the shaft portions 186*a*, 186*b* pass through a center C2 of the connecting portion 186*c* having a spherical shape. Each of the axes of the shaft portions 186*a*, 186*b* is disposed substantially perpendicular to the rotational axis L3 of a preventing member 189. At an end portion of the shaft portion 186*a* with respect to an axial direction, a rotational force transmitting portion 186*a*1 is provided, and at an end portion of the shaft portion 186*b* with respect to the axial direction, a rotational force transmitting portion 186*b*1 is provided. Then, the rotational force transmitting portions 186*a*1 and 186*b*1 contact a rotational force receiving portion 189*c*1 constituting a supporting portion (groove portion) of the preventing member 189, so that the rotational force is transmitted from the coupling member 186 to the preventing member 189. In the case of this constitution, as shown in (b) of FIG. 12, also the shaft portions 186*a*, 186*b* are inclined correspondingly to inclination of the coupling member 186. For that reason, in order not to impair the inclination of the coupling member 186, there is a need that a gap (spacing) H11 is provided between the shaft portion 186*a* and a second retaining portion 187*f* of the driving-side flange 187 and that a gap H12 is provided between the shaft portion 186*b* and a preventing portion 189*c*3 of the preventing member 189. That is, the groove portion (supporting portion) 189*c* of the preventing member 189 is provided substantially in parallel to the axial direction of the photosensitive drum and is a groove portion where one side of the photosensitive drum with respect to the axial direction is open. The groove portion 189*c* supports both ends of the shaft portion so as to permit movement of the shaft portions 186*a*, 186*b* in the axial direction of the photosensitive drum with tilting of the coupling member 186. By this constitution, the pin 88 can be removed (omitted).

Embodiment 2

Figure 13:
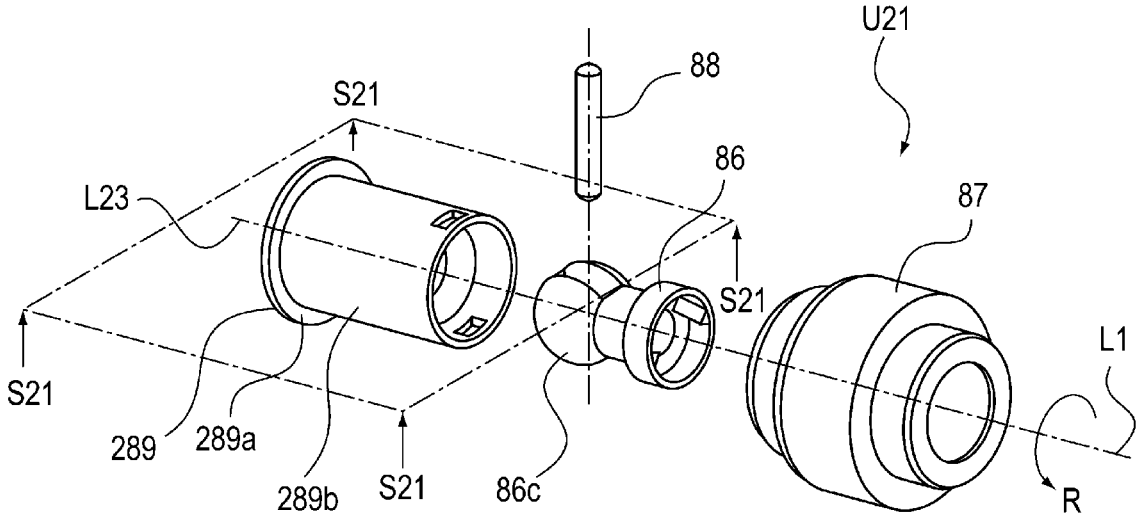
In FIG. 13, (a) and (b) are illustrations each showing a state of a driving-side flange unit in Embodiment 2 to which the present invention is applicable.
Figure 13:
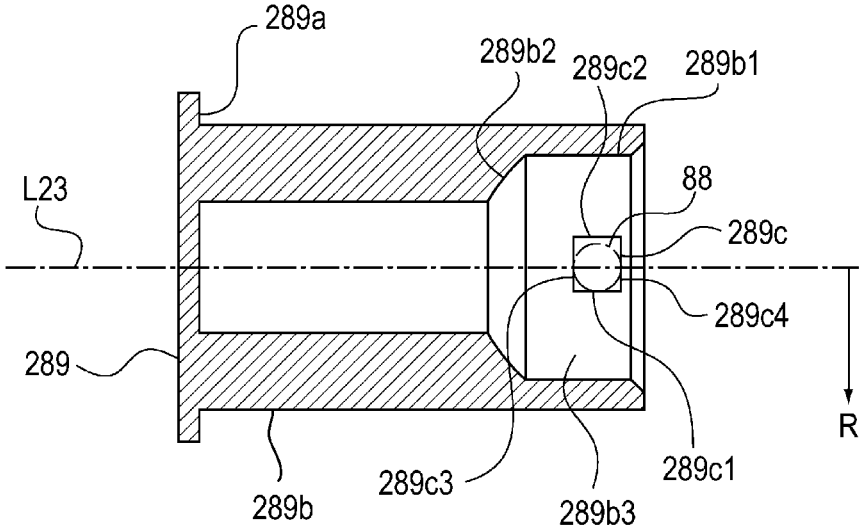
Figure 14:
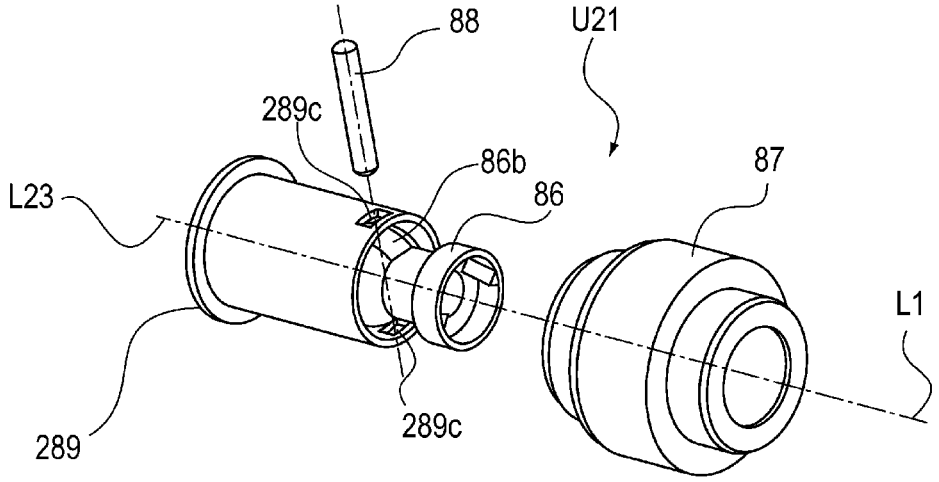
In FIG. 14, (a) and (b) are illustrations each showing an assembling state of the driving-side flange unit in the Embodiment 2.
Figure 14:
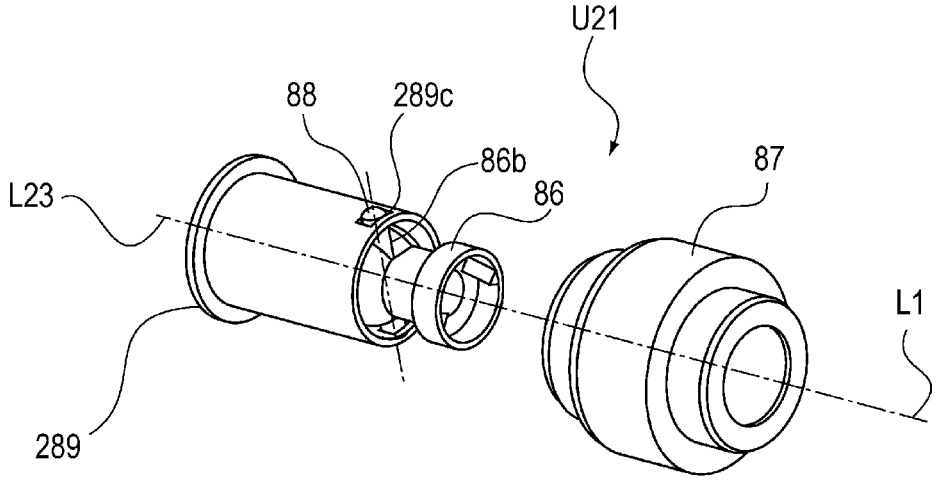

Embodiment 2 to which the present invention is applied will be described using FIGS. 13 and 14. In FIG. 13, (a) is an exploded perspective view of a driving-side flange unit U21 in this embodiment, and (b) is a sectional view of a preventing member 289 cut along a flat plane S21 in (a) of FIG. 13. In FIG. 14, (a) and (b) are illustrations showing a state in which a coupling member 86 and a pin 88 are assembled with the preventing member 289. In this embodiment, a constitution different from the constitution in Embodiment 1 will be described. With respect to members having the same constitutions and functions as those in Embodiment 1 are represented by the same part names and the same reference numerals or symbols and will be omitted from description. This is true for subsequent embodiments.

In this embodiment, compared with Embodiment 1, a shape of the preventing member 289 at a portion supporting the pin 88 is different. This will be specifically described.

As shown in (a) of FIG. 13, the preventing member 289 is provided with a base portion 289*a*, a cylindrical-shaped projected portion 289*b* projecting from the base portion 289*a* substantially in parallel to a rotational axis L23 of the preventing member 289, and a pair of holes 289*c* on a side opposite from the base portion 289*a* with respect to the rotational axis L23. The pair of holes 289*c* is disposed so that their phases are deviated from each other by about 180 deg. around the rotational axis L23. The pair of holes 289*c* is a pair of through holes (supporting portions) surrounding an outer periphery of the pin 88 which is the shaft portion. Further, as shown in (b) of FIG. 13, each of the holes 289*c* is provided with a rotational force receiving portion 289*c*1 and a rotation preventing 289*c*2 which are substantially parallel to the rotational axis L23 and is provided with preventing portions 289*c*3, 289*c*4 which are substantially perpendicular to the rotational axis L23. Further, with respect to the rotational axis L23, the preventing portion 289*c*3 is disposed on the base portion 289*a* side of the hole 289*c*, and the preventing portion 289*c*4 is disposed at a position opposing the preventing portion 289*c*3. As a result, the pin 88 is prevented by the preventing portions 289*c*3, 289*c*4 from moving in a direction parallel to the rotational axis L23. Further, by the rotational force receiving portion 289*c*1 and the rotation preventing portion 289*c*2, movement of the photosensitive drum 62 in the rotational direction R is prevented.

An assembling method of the driving-side flange unit U21 will be described. First, as shown in (a) of FIG. 14, the connecting portion 86*c* of the coupling member 86 is accommodated in an accommodating portion 289*b*3 of the preventing member 289. Then, the pin 88 is inserted into the holes 86*b* of the coupling member 86 and the holes 289*c* of the preventing member 289 ((b) of FIG. 14). As a result, the coupling member 86 and the preventing member 289 can be assembled into a unit by the pin 88. In this embodiment, the coupling member 86, the pin 88 and the preventing member 289 can be assembled with the driving-side flange 87, so that an assembling property when the coupling member 86, the pin 88 and the preventing member 289 are assembled with the driving-side flange 87 is improved. In addition, the rotational force receiving portion 289*c*1 and the rotation preventing portion 289*c*2 are connected by the preventing portion 289*c*4, and therefore deformation of the pin 88 in a direction in which the rotational force receiving portion 289*c*1 is spaced from the rotation preventing portion 289*c*2 when the pin 88 contacts the rotational force receiving portion 289*c*1.

The holes 289*c* and the pin 88 are provided in a press-fitting manner, so that it is possible to prevent separation among the coupling member 86, the pin 88 and the preventing member 289. Therefore, the assembling property when the coupling member 86, the pin 88 and the preventing member 289 are assembled with the driving-side flange 87 can be further improved.

Embodiment 3

Figure 15:
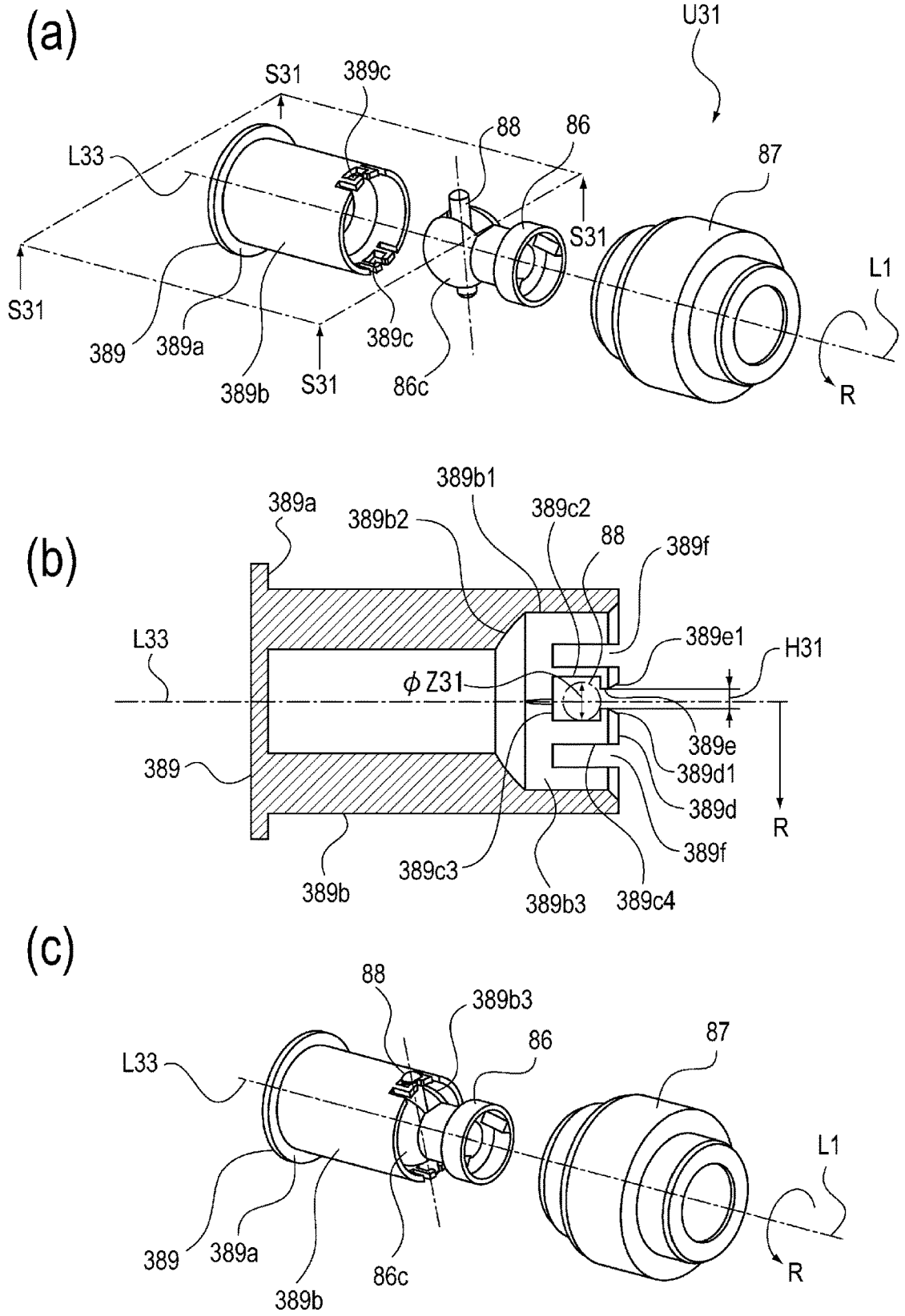
In FIG. 15, (a) to (c) are illustrations each showing a state of a driving-side flange unit in Embodiment 3 to which the present invention is applicable.

Embodiment 3 to which the present invention is applied will be described using FIG. 15. In FIG. 15, (a) is an exploded perspective view of a driving-side flange unit U31 in this embodiment, (b) is a sectional view of a preventing member 389 cut along a flat plane S31 in (a) of FIG. 15, and (c) is an illustration showing a state in which a coupling member 86 and a pin 88 are assembled with the preventing member 389.

In this embodiment, compared with Embodiments 1 and 2, a shape of the preventing member 389 at a portion supporting the pin 88 is different. This will be specifically described.

As shown in (a) of FIG. 15, the preventing member 389 is provided with a base portion 389*a*, a cylindrical-shaped projected portion 389*b* projecting from the base portion 389*a* substantially in parallel to a rotational axis L33 of the preventing member 389, and a pair of groove portions 389*c* substantially parallel to a rotational axis L33 of the projected portion 389*b*. The pair of groove portions 389*c* is disposed so that their phases are deviated from each other by about 180 deg. around the rotational axis L33. Further, as shown in (b) of FIG. 15, each of the groove portions 389*c* is provided with a rotational force receiving portion 389*c*1 and a rotation preventing 389*c*2 which are substantially parallel to the rotational axis L33 and is provided with a preventing portion 389*c*3 which is substantially perpendicular to the rotational axis L33. Further, with respect to the rotational axis L33, the preventing portion 389*c*3 is positioned on the non-driving side of the groove portion 389*c*, and the groove portion 389*c* is open on the driving side. In addition, the rotational force receiving portion 389*c*1 is provided with a projected portion 389*d* so as to project in the rotational direction R of the photosensitive drum 62, and the rotation preventing portion 389*c*2 is provided with a projected portion 389*e* projecting in the rotational direction R of the photosensitive drum 62. Further, with respect to the rotational direction R, cut-away portions 389*f* disposed so as to sandwich the groove portion 389*c* are provided.

The projected portions 389*d*, 389*e* may only be required to be provided at least at either one of the portions 389*c*1, 389*c*2, and in the case where either one of the projected portions 389*d*, 389*e* is provided, also the cut-away portion 389*f* may only be required to be provided at one position. At this time, in the case where the rotation preventing portion 389*c*2 is provided with the cut-away portion 389*f* and the rotational force receiving portion 389*c*1 is not provided with the cut-away portion 389*f*, when the pin 88 contacts the rotational force receiving portion 389*c*1, it is possible to suppress deformation of the rotational force receiving portion 389*c*1 in a direction in which the rotational force receiving portion 389*c*1 spaces from the rotation preventing portion 389*c*2.

An assembling method of the driving-side flange unit U31 will be described. The coupling member 86 and the pin 88 are paired with each other and are assembled with the preventing member 389 along the rotational axis L33. At this time, a gap H31 between the projected portions 389*d*, 389*e* is smaller than an outer diameter φZ31 of the pin 88, and therefore the pin and the projected portions 389*d*, 389*e* contact each other. Here, a contact portion 389*d*1 of the projected portion 389*d* provided on the rotational force receiving portion 389*c*1 is provided so as to incline in a direction in which the contact portion 389*d*1 spaces from the rotational force receiving portion 389*c*1 with a decreasing distance from the preventing portion 389*c*3 along the rotational axis L33 ((b) of FIG. 15). Also a contact portion 389*e*1 of the projected portion 389*e* provided on the rotation preventing portion 389*c*2 is similarly formed. For that reason, when the pin 88 is pushed into the groove portion 389*c* along the rotational axis L33, the pin 88 passes through the projected portion 389*d* while the groove portion 389*c* is elastically deformed in a direction in which the cut-away portions 389*f* are provided. Then, as shown in (c) of FIG. 15, when the coupling member 86 and the pin 88 are further moved along the rotational axis L33, the connecting portion 86*c* of the coupling member 86 is accommodated in an accommodating portion 389*b*3 and the pin 88 is accommodated in the groove portion 389*c*. As a result, the pin 88 is prevented from moving in a direction parallel to the rotational axis L33 by the preventing portion 389*c*3 and the projected portion 389*d*. Further, by the rotational force receiving portion 389*c*1 and the rotation preventing portion 389*c*2 of the preventing member 389, movement of the photosensitive drum 62 in the rotational direction R is prevented. As a result, as assembling property when the coupling member 86 and the preventing member 389 are assembled into the unit is improved by the pin 88.

Embodiment 4

Figure 16:
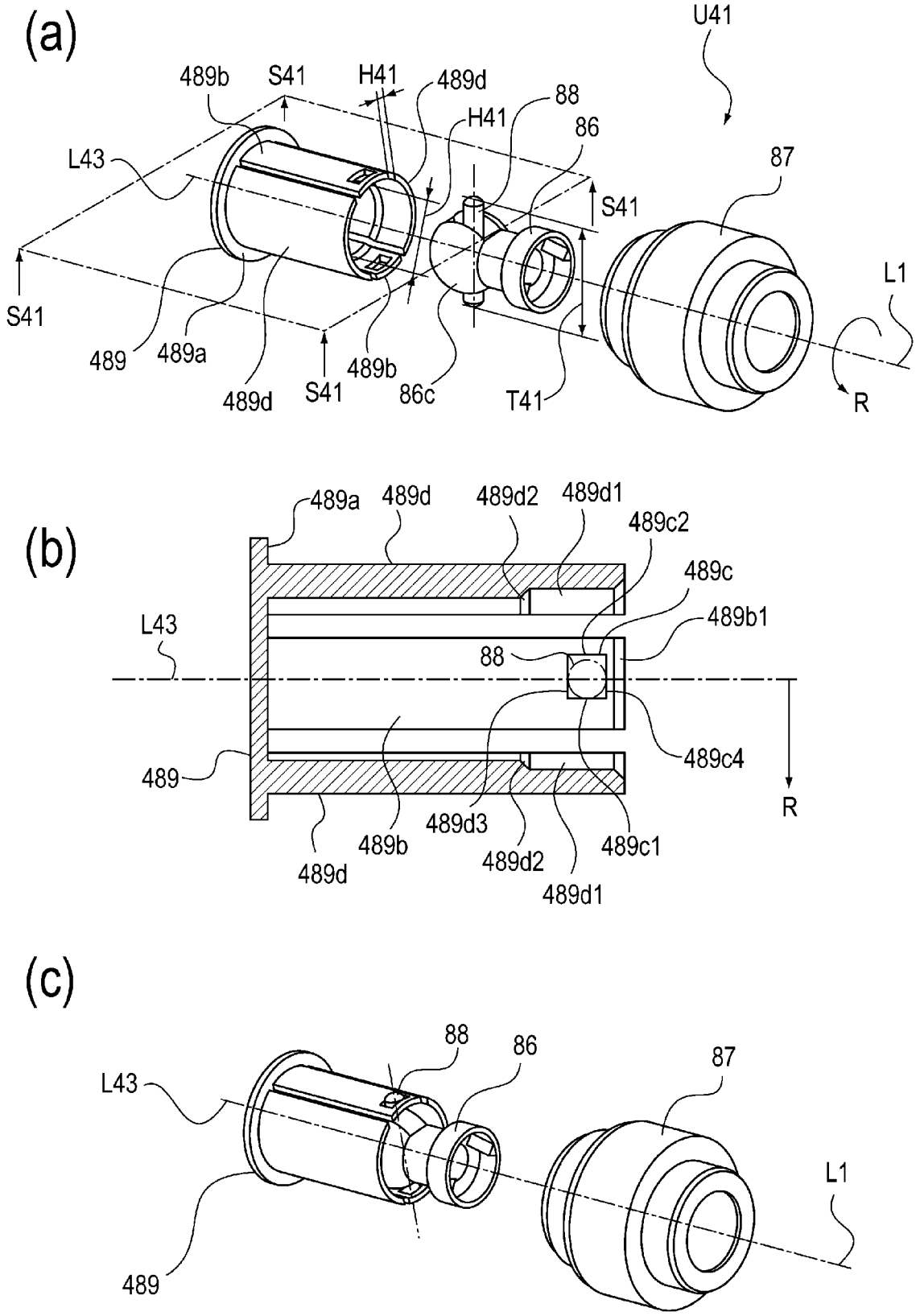
In FIG. 16, (a) to (c) are illustrations each showing a state of a driving-side flange unit in Embodiment 4 to which the present invention is applicable.

Embodiment 4 to which the present invention is applied will be described using FIG. 16. In FIG. 16, (a) is an exploded perspective view of a driving-side flange unit U41 in this embodiment, (b) is a sectional view of a preventing member 489 cut along a flat plane S41 in (a) of FIG. 16, and (c) is an illustration showing a state in which a coupling member 86 and a pin 88 are assembled with the preventing member 489.

In this embodiment, compared with Embodiments 1 to 3, a deformation direction of a shape of the preventing member 489 at a portion supporting the pin 88 is different. This will be specifically described.

As shown in (a) of FIG. 16, the preventing member 489 is provided with a base portion 489*a* and a cylindrical-shaped pair of projected portions 489*b* projecting from the base portion 489*a* substantially in parallel to a rotational axis L43 of the preventing member 389. Further, each of the projected portions 489*b* is provided with a hole 489*c* on a side opposite from the base portion 489*a* with respect to the rotational axis L43. The pair of holes 489*c* is disposed so that their phases are deviated from each other by about 180 deg. around the rotational axis L43. The pair of holes 489*c* is a pair of through holes (supporting portions) surrounding an outer periphery of the pin 88 which is the shaft portion. Further, as shown in (b) of FIG. 16, each of the groove portions 489*c* is provided with a rotational force receiving portion 489*c*1 and a rotation preventing 489*c*2 which are substantially parallel to the rotational axis L43 and is provided with preventing portions 489*c*3, 489*c*4 which are substantially perpendicular to the rotational axis L43. Further, with respect to the rotational axis L43, the preventing portion 489*c*3 is disposed on the base portion 489*a* side of the hole 489*c*, and the preventing portion 489*c*4 is disposed at a position opposing the preventing portion 489*c*4. On the other hand, a cylindrical-shaped pair of second projected portions 489*d* projecting from the base portion 489*a* substantially in parallel to the rotational axis L43. Further, between the projected portions 489*b* and the second projected portions 489*d*, a gap H41 is provided along the rotational axis L43. Inside the second projected portions 489*d*, a first supporting portion 489*d*1 and a second supporting portion 489*d*2 for preventing the connecting portion

86*c* of the coupling member 86 are provided. Further, an accommodating portion 489*c*3 surrounded by the first and second supporting portions 489*d*1, 489*d*2 is formed.

An assembling method of the driving-side flange unit U41 will be described. The coupling member 86 and the pin 88 are paired with each other and are assembled with the preventing member 489 along the rotational axis L43. At this time, a gap H41 between the pair of projected portions 489*b* is smaller than a full length T41 of the pin 88, and therefore the pin 88 and a contact portion 489*b*1 of the projected portion 489*e* contact each other. Here, the contact portion 489*d*1 of is provided so as to incline in a direction in which the contact portion 489*d*1 approaches the rotational axis L43 along the rotational axis L43. For that reason, when the pin 88 is moved along the rotational axis L43, the pin 88 passes through the contact portion 489*b*1 while the project portions 489*b* are elastically deformed in a direction of being spaced from the rotational axis L43. Then, as shown in (c) of FIG. 16, when the coupling member 86 and the pin 88 are further moved along the rotational axis L43, the connecting portion 86*c* of the coupling member 86 is accommodated in the accommodating portion 489*d*3 and the pin 88 is accommodated in the hole 489*d*. As a result, the pin 88 is prevented from moving in a direction parallel to the rotational axis L43 by the preventing portions 489*c*3, 489*c*4. Further, by the rotational force receiving portion 489*c*1 and the rotation preventing portion 489*c*2 of the preventing member 489, movement of the photosensitive drum 62 in the rotational direction R is prevented. As a result, as assembling property when the coupling member 86 and the preventing member 489 are assembled into the unit is improved by the pin 88. In addition, the rotational force receiving portion 489*c*1 and the rotation preventing portion 489*c*2 are connected by the preventing portion 489*c*4, and therefore it is possible to suppress deformation of the pin 88 in a direction in which the rotational force receiving portion 489*c*1 is spaced from the rotation preventing portion 489*c*2 when the pin 88 contacts the rotational force receiving portion 489*c*1.

Other Embodiments

The form of the cartridge B in the above-described embodiments was described using the process cartridge including the photosensitive drum and the process means as an example, but is not limited thereto. As the form of the cartridge B, for example, the present invention is suitably applied to also a photosensitive drum cartridge which is not provided with the process means but is provided with the photosensitive drum 1. Further, the present invention is also suitably applied to a developing cartridge which is not provided with the photosensitive drum but is provided with the developing roller 32 and in which the rotational force is transmitted from the main assembly-side engaging portion to the developing roller 32 for carrying the toner while being rotated. In this case, the coupling member transmits the rotational force to the driving roller as a rotatable member in place of the photosensitive drum.

In the embodiments described above, the driving-side flange as the rotational force receiving member has the constitution in which the driving-side flange is fixed to the longitudinal end portion of the photosensitive drum which is the recording material, but may also have a constitution in which the rotational force receiving member and the rotatable member are not fixed to each other but may also be independently provided from each other. For example, a constitution in which the rotational force receiving member is a gear member and is connected with the rotatable member such as the photosensitive drum or the developing roller by engagement of gears.

In the above-described embodiments, the cartridge B is used for forming a monochromatic (single-color), but is not limited thereto. The present invention is suitably applicable to a cartridge in which a plurality of developing means are provided and a plurality of color images (for example, two color images, three color images or a full-color image) are formed.

In the above-described embodiments, the constitution in which the spacing holding members 17L, 17R are contacted to the outer peripheral surfaces of the photosensitive drum 62 and thus the developing roller 32 is urged toward the photosensitive drum 62 is employed, but the present invention is not limited thereto. For example, the present invention is suitably applicable to also a constitution in which an outer peripheral surface of the developing roller 32 is directly contacted to the outer peripheral surface of the photosensitive drum 62 to be urged toward the photosensitive drum 62.

In the above-described embodiments, the printer is described as the image forming apparatus, but the present invention is not limited thereto. For example, the image forming apparatus may also be other image forming apparatuses such as a copying machine, a facsimile machine, a multi-function machine having a combination of functions of these machines, and so on. Or, the image forming apparatus may also be an image forming apparatus in which a recording material carrying member is used and color toner images are successively transferred superposedly onto a recording material carried on the recording material carrying member. The image forming apparatus may also be an image forming apparatus in which an intermediary transfer member is used and in which color toner images are successively transferred superposedly onto the intermediary transfer member and then are collectively transferred from the intermediary transfer member. By applying the present invention to the cartridges for use with these image forming apparatuses, a similar effect can be obtained.

When the present invention is carried out, the constitutions and the arrangements of the above-described embodiments may also be appropriately selected and combined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

As described above, according to the present invention, in a cartridge for use with an image forming apparatus, a degree of deformation of a rotational force receiving member is reduced when a rotational force is transmitted to the rotational force receiving member. Further, according to the present invention, when the rotational force receiving member is molded, a flowability of a resin material is made uniform, so that the rotational force receiving member is molded with high accuracy.

The invention claimed is:

1. A cartridge detachably mountable to a main assembly of an image forming apparatus, the cartridge comprising:

a rotatable member;

a rotational force receiving member for transmitting a rotational force to the rotatable member;

a preventing member connected to the rotational force receiving member and including an accommodating portion therein;

a rotatable coupling member including (i) a free end portion that includes a rotational force receiving portion for receiving the rotational force and (ii) a connecting portion connected to the preventing member to be partly accommodated in the accommodating portion so that a rotational axis of the coupling member is tiltable relative to a rotational axis of the rotational force receiving member; and a shaft portion capable of receiving the rotational force from the coupling member, wherein the rotational axis of the coupling member is tiltable relative to the shaft portion, wherein the preventing member includes a supporting portion for supporting one end of the shaft portion so as to prevent the shaft portion from moving in a rotational direction of the rotatable member to transmit the rotational force received from the shaft portion via the supporting portion to the rotational force receiving member, wherein the supporting portion is provided with a recess recessed in a rotational axis direction of the rotatable member and having a channel-like shape as seen in a radial direction of the supporting portion, the recess having a first surface and a second surface that are contactable to the one end of the shaft portion, wherein the first surface and the second surface are disposed opposed to each other with respect to the one end of the shaft portion, wherein the one end of the shaft portion is prevented from moving in a rotational direction of the rotatable member relative to the preventing member, and wherein the rotational force receiving member and the preventing member are separate parts connected together.

2. A cartridge according to claim 1, wherein the supporting portion is a groove portion that opens at one end of the rotatable member with respect to an axial direction of the rotatable member, and wherein the supporting portion supports the one end of the shaft portion so as to prevent the shaft portion from moving toward the other end of the rotatable member with respect to the axial direction.

3. A cartridge according to claim 1, wherein the shaft portion is formed integrally with the coupling member, wherein the supporting portion is provided substantially parallel to the axial direction of the rotatable member and is a groove portion that opens at one end of the rotatable member with respect to an axial direction of the rotatable member, and wherein the supporting portion supports the one end of the shaft portion so as to permit movement of the shaft portion in the axial direction of the rotatable member.

4. A cartridge according to claim 1, wherein the supporting portion is a through hole surrounding an outer periphery of the shaft portion, and wherein the supporting portion supports the one end of the shaft portion so as to prevent the shaft portion from moving in an axial direction of the rotatable member.

5. A cartridge according to claim 1, wherein the supporting portion elastically deforms.

6. A cartridge according to claim 1, wherein the cartridge is detachably mountable to the main assembly including a rotatably supported main assembly side engaging portion, and the cartridge is demountable to an outside of the main assembly after being moved in a predetermined direction substantially perpendicular to a rotational axis of the main assembly side engaging portion.

7. A cartridge according to claim 6, wherein the coupling member is tilted with demounting thereof from the main assembly to disengage the rotational force receiving portion from the main assembly side engaging portion.

8. A cartridge according to claim 1, wherein the rotatable member rotates while carrying developer.

9. A cartridge according to claim 1, wherein the preventing member prevents the coupling member and the shaft portion from demounting from the rotational force receiving member.

10. A cartridge according to claim 1, wherein the rotational force receiving member includes a retaining portion for preventing movement of the shaft portion in an axial direction of the rotatable member.

11. A cartridge according to claim 1, wherein the rotational force receiving member includes a portion to be fixed that is contacted and fixed to the rotatable member.

12. A cartridge according to claim 1, wherein the rotational force receiving member includes a gear portion.

13. A cartridge according to claim 1, wherein the rotational force receiving member includes a first connecting surface and the preventing member includes a second connecting surface fixed to the first connecting surface, wherein the first connecting surface and the second connecting surface are fixed to each other by welding.

14. A cartridge according to claim 1, wherein the rotational force receiving member includes a first connecting surface and the preventing member includes a second connecting surface fixed to the first connecting surface, wherein the first connecting surface and the second connecting surface are fixed to each other by bonding.

15. An image forming apparatus comprising:

a main assembly that includes a rotatably supported main assembly side engaging portion; and a cartridge demountable to an outside of the main assembly after being moved in a predetermined direction substantially perpendicular to a rotational axis of the main assembly side engaging portion, wherein the cartridge includes:

a rotatable member that is rotatable while carrying developer;

a rotational force receiving member for transmitting a rotational force to the rotatable member, a preventing member connected to the rotational force receiving member and including an accommodating portion thereof, a rotatable coupling member including (i) a free end portion that includes a rotational force receiving portion for receiving the rotational force from the main assembly side engaging portion and (ii) a connecting portion connected to the preventing member to be partly accommodated in the accommodating portion so that a rotational axis of the coupling member is tiltable relative to a rotational axis of the rotational force receiving member to demount the rotational force receiving portion from the main assembly side engaging portion, and a shaft portion capable of receiving the rotational force from the coupling member, wherein the rotational axis of the coupling member is tiltable relative to the shaft portion, wherein the preventing member includes a supporting portion for supporting one end of the shaft portion so as to prevent the shaft portion from moving in a rotational direction of the rotatable member to transmit the rotational force received from the shaft portion via the supporting portion to the rotational force receiving member, wherein the supporting portion is provided with a recess recessed in a rotational axis direction of the rotatable member and having a channel-like shape as seen in a radial direction of the supporting portion, the recess having a first surface and a second surface that are contactable to the one end of the shaft portion, wherein the first surface and the second surface are disposed opposed to each other with respect to the one end of the shaft portion, wherein the one end of the shaft portion is prevented from moving in a rotational direction of the rotatable member relative to the preventing member, and wherein the rotational force receiving member and the preventing member are separate parts connected together.

16. An image forming apparatus according to claim 15, wherein the supporting portion is a groove portion that opens at one end of the rotatable member with respect to an axial direction of the rotatable member, and wherein the supporting portion supports the one end of the shaft portion so as to prevent the shaft portion from moving toward the other end of the rotatable member with respect to the axial direction.

17. An image forming apparatus according to claim 15, wherein the shaft portion is formed integrally with the coupling member, wherein the supporting portion is provided substantially parallel to the axial direction of the rotatable member and is a groove portion that opens at one end of the rotatable member with respect to an axial direction of the rotatable member, and wherein the supporting portion supports the one end of the shaft portion so as to permit movement of the shaft portion in the axial direction of the rotatable member.

18. An image forming apparatus according to claim 15, wherein the supporting portion is a through hole surrounding an outer periphery of the shaft portion, and wherein the supporting portion supports the one end of the shaft portion so as to prevent the shaft portion from moving in an axial direction of the rotatable member.

19. An image forming apparatus according to claim 15, wherein the supporting portion elastically deforms.

20. An image forming apparatus according to claim 15, wherein the rotational force receiving member includes a retaining portion for preventing movement of the shaft portion in an axial direction of the rotatable member.

21. An image forming apparatus according to claim 15, wherein the rotational force receiving member includes a portion to be fixed that is contacted and fixed to the rotatable member.

22. An image forming apparatus according to claim 15, wherein the rotational force receiving member includes a gear portion.

23. An image forming apparatus according to claim 15, wherein the rotational force receiving member includes a first connecting surface and the preventing member includes a second connecting surface fixed to the first connecting surface, wherein the first connecting surface and the second connecting surface are fixed to each other by welding.

24. An image forming apparatus according to claim 15, wherein the rotational force receiving member includes a first connecting surface and the preventing member includes a second connecting surface fixed to the first connecting surface, wherein the first connecting surface and the second connecting surface are fixed to each other by bonding.

25. An assembling method of a drive transmission unit for transmitting a rotational force to a rotatable member, wherein the drive transmission unit includes:

a rotational force receiving member for transmitting a rotational force to the rotatable member, a preventing member connected to the rotational force receiving member and including an accommodating portion therein, a rotatable coupling member including (i) a free end portion that includes a rotational force receiving portion for receiving the rotational force and (ii) a connecting portion connected to the preventing member to be partly accommodated in the accommodating portion so that a rotational axis of the coupling member is tiltable relative to a rotational axis of the rotational force receiving member, and a shaft portion capable of receiving the rotational force from the coupling member, wherein the preventing member includes a supporting portion for supporting one end of the shaft portion so as to transmit the rotational force received from the shaft portion via the supporting portion to the rotational force receiving member, and wherein the supporting portion is provided with a recess recessed in a rotational axis direction of the rotatable member and having a channel-like shape as seen in a radial direction of the supporting portion, the recess having a first surface and a second surface, the assembling method comprising:

a step of supporting one end of the shaft portion by the supporting portion for preventing movement of the shaft portion relative to the preventing member in a rotational direction of the rotatable member while accommodating the connecting portion of the coupling member in the accommodating portion, and then a step of connecting the preventing member supporting the shaft portion by the supporting portion and accommodating the connecting portion of the coupling member in the accommodating portion with the rotational force receiving member, wherein the first surface and the second surface are disposed opposed to each other with respect to the one end of the shaft portion and contactable to the one end of the shaft portion by the step of supporting the one end of the shaft portion by the supporting portion, and wherein the rotational axis of the coupling member is tiltable relative to the shaft portion.

26. An assembling method according to claim 25, wherein the rotational force receiving member includes a first connecting surface and the preventing member includes a second connecting surface fixed to the first connecting surface, wherein in the step of connecting the coupling member and the preventing member, the first connecting surface and the second connecting surface are fixed to each other by welding.

27. An assembling method according to claim 25, wherein the rotational force receiving member includes a first connecting surface and the preventing member includes a second connecting surface fixed to the first connecting surface, wherein in the step of connecting the coupling member and the preventing member, the first connecting surface and the second connecting surface are fixed to each other by bonding.

* * * * *